US007425937B2

(12) United States Patent
Inukai

(10) Patent No.: US 7,425,937 B2
(45) Date of Patent: Sep. 16, 2008

(54) DEVICE AND DRIVING METHOD THEREOF

(75) Inventor: Kazutaka Inukai, Kanagawa (JP)

(73) Assignee: Semiconductor Energy Laboratory Co., Ltd. (JP)

( * ) Notice: Subject to any disclaimer, the term of this patent is extended or adjusted under 35 U.S.C. 154(b) by 10 days.

(21) Appl. No.: 10/633,964

(22) Filed: Aug. 4, 2003

(65) Prior Publication Data

US 2004/0041754 A1 Mar. 4, 2004

(30) Foreign Application Priority Data

Aug. 9, 2002 (JP) ..... 2002-234216

(51) Int. Cl.
*G09G 3/30* (2006.01)

(52) U.S. Cl. ..... 345/76

(58) Field of Classification Search ..... 345/204, 345/205, 206, 87–99, 100, 76
See application file for complete search history.

(56) References Cited

U.S. PATENT DOCUMENTS

| | | | | |
|---|---|---|---|---|
| 5,805,128 | A * | 9/1998 | Kim et al. | 345/96 |
| 5,952,789 | A * | 9/1999 | Stewart et al. | 315/169.4 |
| 5,999,154 | A * | 12/1999 | Yoshioka | 345/89 |
| 6,219,022 | B1 | 4/2001 | Yamazaki et al. | |
| 6,246,399 | B1 | 6/2001 | Yamane et al. | |
| 6,528,950 | B2 * | 3/2003 | Kimura | 315/169.3 |
| 6,545,655 | B1 * | 4/2003 | Fujikawa | 345/87 |
| 6,548,960 | B2 * | 4/2003 | Inukai | 315/169.3 |
| 6,730,966 | B2 | 5/2004 | Koyama | |
| 6,825,820 | B2 | 11/2004 | Yamazaki et al. | |
| 6,825,834 | B2 | 11/2004 | Miyajima | |
| 6,867,761 | B2 | 3/2005 | Matsueda | |
| 6,930,447 | B2 | 8/2005 | Kim | |
| 6,982,462 | B2 | 1/2006 | Koyana | |
| 7,045,369 | B2 | 5/2006 | Yamazaki et al. | |
| 7,071,911 | B2 | 7/2006 | Inukai | |
| 7,184,014 | B2 | 2/2007 | Koyama et al. | |
| 2001/0035863 | A1 * | 11/2001 | Kimura | 345/205 |

(Continued)

FOREIGN PATENT DOCUMENTS

| | | |
|---|---|---|
| EP | 1 063 630 A2 | 12/2000 |

(Continued)

*Primary Examiner*—Prabodah Dharia
(74) *Attorney, Agent, or Firm*—Cook Alex Ltd.

(57) ABSTRACT

To provide a display device and its driving method free from lack of writing time, which usually accompanies an increase in size of a display device and enhancement in definition. Therefore, there is provided a display device and a driving method in which x (x is a natural number equal to or larger than 4) data lines are placed in each column to simultaneously supply video signals to x pixels through the x data lines. The present invention makes it possible to supply video signals to x pixels simultaneously as opposed to conventional dot sequential driving where a signal is supplied to one pixel at a time. Furthermore, a display device of the present invention and its driving method make it possible to supply video signals to (x×n) pixels at once as opposed to conventional linear sequential driving where only n pixels in the first to last (the last column is the n-th column) columns receive signals simultaneously. Thus the present invention can make the speed of writing video signals in pixels x times faster than prior art.

39 Claims, 14 Drawing Sheets

U.S. PATENT DOCUMENTS

| | | | | |
|---|---|---|---|---|
| 2002/0044124 | A1* | 4/2002 | Yamazaki et al. | 345/92 |
| 2002/0153844 | A1 | 10/2002 | Koyama | 315/169.3 |
| 2003/0006997 | A1* | 1/2003 | Ogawa et al. | 345/690 |
| 2004/0207578 | A1 | 10/2004 | Koyama | |
| 2005/0093802 | A1 | 5/2005 | Yamazaki et al. | |
| 2006/0033161 | A1 | 2/2006 | Koyama | |
| 2006/0183254 | A1 | 8/2006 | Yamazaki et al. | |
| 2006/0220942 | A1* | 10/2006 | Choi et al. | 341/172 |
| 2007/0109247 | A1 | 5/2007 | Koyama et al. | |

FOREIGN PATENT DOCUMENTS

| | | | |
|---|---|---|---|
| EP | 1 107 220 | A2 | 6/2001 |
| EP | 1 193 675 | A2 | 4/2002 |
| EP | 1 198 017 | A2 | 4/2002 |
| EP | 1 204 089 | A1 | 5/2002 |
| EP | 1 575 024 | A1 | 9/2005 |
| JP | S52-19960 | | 5/1977 |
| JP | 63-18331 | | 1/1988 |
| JP | 63-92928 | | 4/1988 |
| JP | 2-214818 | | 8/1990 |
| JP | 11-102172 | | 4/1999 |
| JP | 2000-29432 | | 1/2000 |
| JP | 2001-005426 | | 1/2001 |
| JP | 2001-33756 | | 2/2001 |
| JP | 2001-034237 | | 2/2001 |
| JP | 2002-108243 | | 4/2002 |
| JP | 2002-149112 | | 5/2002 |
| JP | 2002-151276 | | 5/2002 |
| JP | 2002-175045 | | 6/2002 |
| JP | 2002-190390 | | 7/2002 |
| JP | 2002-196306 | | 7/2002 |
| JP | 2002-196721 | | 7/2002 |
| JP | 2002-207442 | | 7/2002 |
| JP | 2002-214645 | | 7/2002 |
| JP | 2002-278478 | | 9/2002 |
| JP | 2003-087562 | | 3/2003 |

* cited by examiner

DEVICE AND DRIVING METHOD THEREOF

BACKGROUND OF THE INVENTION

1. Field of the Invention

The present invention relates to a display device using a light emitting element and belongs to a technical field of a large-sized display device having high resolution.

2. Description of the Related Art

Recently, a display device for displaying an image has been more and more important. At present, a liquid crystal display device that displays an image using a liquid crystal element is widely used, taking advantages of high-definition, thinness and lightness in weight. Further, a display device (a light emitting device) using a light emitting element such as organic light emitting diode (OLED) has being developed as another display device. The light emitting device using OLED (OLED display device) draws keen attention because the light emitting device has advantages such as a high response speed, superior moving image display and a wide viewing characteristic in addition to the advantages of existing liquid crystal display devices. An OLED adopted in the light emitting device as a typical light emitting element has a structure which includes a single thin film or a laminated thin film between a conductive anode and a conductive cathode. Organic materials are included in a part of or all layers of the thin film. It is usual that the luminance of the organic light emitting diode is in directly proportion to the current value thereof.

Hereinafter, a light emitting device has a light emitting element (e.g. OLED) and a plurality of pixels having at least two transistors arranged in a matrix pattern. A transistor that serially connects to a light emitting element and controls the luminance thereof in pixels is referred to as a driving transistor. A video signal of current or voltage value type is used to control pixels. When the video signal of voltage value type is used, a signal voltage is generally input to a gate electrode of a driving transistor to control the luminance of a light emitting element using the driving transistor. When the video signal of current value type is used, a light emitting device is provided with a current equivalent to a predetermined current value type from a driving transistor to control the luminance of the light emitting element. Whether the video signal is of current value type or voltage value type, there are two cases: a case where an analog value signal is used (hereinafter, referred to as an analog driving) and a case where a digital value signal is used (hereinafter, referred to as a digital driving). When the digital driving is performed, the digital driving can be combined with a time-division driving by which intermediate gray scale is displayed using a time ratio (e.g. Japanese Patent Laid-Open No. 2001-5426) or an area-division driving by which intermediate gray scale is displayed using an area ratio (e.g. Japanese Patent Laid-Open No. 2002-278478). The response speed of OLED is higher than that of a liquid crystal or the like, therefore OLED is suitable for the time-division driving in case of the digital driving.

Here are described schematically a pixel portion and a driver circuit of a display device operating conventional matrix display with reference to FIG. 7. The pixel portion is composed of a plurality of scanning lines that are arranged in the row direction of horizontal scanning, a plurality of data lines that are arranged in the column direction perpendicular to the rows and a matrix of pixels. In this manner, a plurality of pixels are regularly arranged in the pixel portion and one scanning line and one data line are also arranged in one row and one column, respectively.

When the frequency of a frame is constant, one horizontal scanning period become shorter with raising resolution of a pixel portion. For example, when the frequency of a frame is 60 Hz and the number of pixels is SXGA standard (1280×1024), one horizontal scanning period is about 16 μsec. At this time, it is difficult to obtain the period to write a video signal in a pixel. In particular, this trend is noticeable for a large-sized display whose parasitic capacitance is large.

Here are specific examples described. Firstly, a digital time-division gray scale is described, whether a video signal is of current value type or voltage value type. When one frame is divided to about 15 sub frames to perform the time-division driving, one horizontal scanning period in case that the number of pixels is SXGA standard (1280×1024) is typically 1 μsec. or less, therefore the period to write in is insufficient.

Next, an analog driving using a video signal of current value type is described here. In displaying low luminescent gray scale whose video signal current applied to an light emitting element is low, the speed to write in is sluggish and therefore the period to write in is insufficient in practical.

SUMMARY OF THE INVENTION

The present invention has been made in view of the above problems. It is an object of the present invention to provide a display device and its driving method free from lack of writing time, which usually accompanies an increase in size of a display device and enhancement in definition. More particularly, a further object of the present invention is to provide a display device and its driving method free from lack of writing time, which is prominent when a current value type signal is used in digital time-division driving or in analog driving.

In order to attain the above object, the present invention provides a display device and its driving method in which x (x is a natural number equal to or larger than 4) data lines are placed in each column to simultaneously supply video signals to x pixels through the x data lines. The present invention makes it possible to supply video signals to x pixels simultaneously as opposed to conventional dot sequential driving where a signal is supplied to one pixel at a time. Furthermore, a display device of the present invention and its driving method make it possible to supply video signals to (x×n) pixels at once as opposed to conventional linear sequential driving where only n pixels in the first to last (here, the last column is the n-th column) columns receive signals simultaneously. Thus the present invention can make the speed of writing video signals in pixels x times faster than prior art.

According to the present invention, there is provided a display device including:

a plurality of data lines in a column direction;

a plurality of scanning lines in a row direction; and a plurality of pixels arranged into a matrix pattern, the pixels each having a light emitting element (typically, an organic light emitting diode (OLED)), in which x data lines (x is a natural number equal to or larger than 4) out of the plural data lines are placed in each column.

The present invention is also applicable to the case where an upper data driver and a lower data driver are provided to write video signals in pixels while operating pixels in the upper half of the screen and pixels in the lower half of the screen separately (hereinafter referred to as horizontally-split driving). With the upper half and the lower half combined, the number of data lines in each column can be set to (2×x) (x is a natural number equal to or larger than 2).

Having the above structure, the present invention provides a display device and its driving method free from lack of writing time, which usually accompanies an increase in size of a display device and enhancement in definition. Specifically, the present invention provides a display device and its driving method free from lack of writing time, which is prominent when a current value type signal is used in digital time-division driving or in analog driving.

DETAILED DESCRIPTION OF THE PREFERRED EMBODIMENT MODES

Embodiment Mode 1

The present invention is described with reference to FIGS. 1, 2A to 2C, 3A to 3E, 8A to 8C, 9A to 9C, 13A to 13C, and 14A to 14C.

Figure 1:
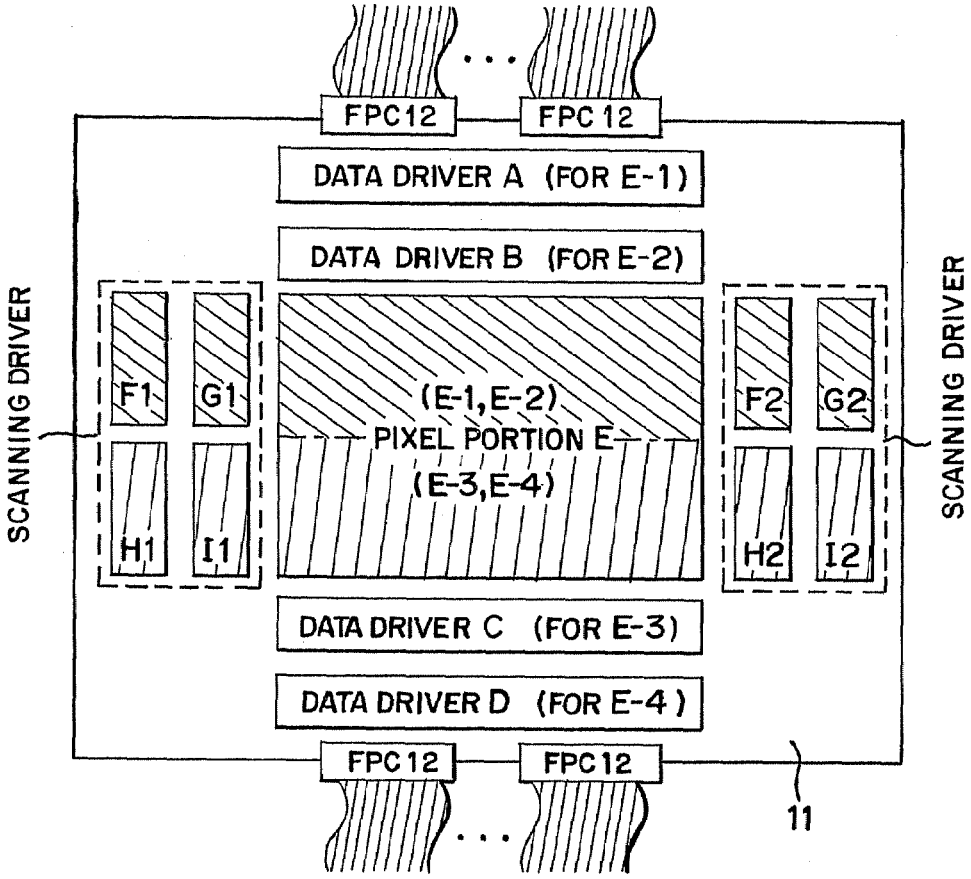
FIG. 1 shows a display device.

The description given first with reference to FIG. 1 is about a structural example of a display device of the present invention. The display device has a pixel portion E, which is formed on a substrate 11. The display device also has data drivers (here, four data drivers A to D) and scanning drivers (eight scanning drivers F1 to I1, F2 to I2) placed in the periphery of the pixel portion E. A pixel E-1 in the upper half of the screen is driven by the drivers A, F1, and F2 whereas a pixel E-2 in the upper half of the screen is driven by the drivers B, G1, and G2. Similarly, a pixel E-3 in the lower half of the screen is driven by C, H1, and H2 whereas a pixel E-4 in the lower half is driven by D, I1, and I2.

This mode is premised on horizontally-split driving but it is not a requisite in carrying out the present invention. However, combined with horizontally-split driving, the present invention can provide more time for writing video signals in pixels.

The data drivers A to D and the scanning drivers F1 to I1 and F2 to I2 receive external signals through FPCs 12. These drivers may be formed on the substrate 11 or may be external to the substrate 11 and formed in a separate IC. The number of the drivers is not particularly limited and can be set in accordance with the pixel structure and the like. Preferably, the number of data drivers matches the number of data lines per column. Although the pixel portion E here is divided into four regions, E-1 to E-4, the present invention is not limited thereto. The pixel portion can be divided into any number of regions.

Note that the term display device includes a panel in which a pixel portion having light emitting elements and driver circuits are sealed between a substrate and a cover member, a module obtained by mounting an IC or the like to the panel, a display used as a monitor for a personal computer, etc. In short, 'display device' is a generic term for such panels, modules, displays, and the like.

Figure 13A:
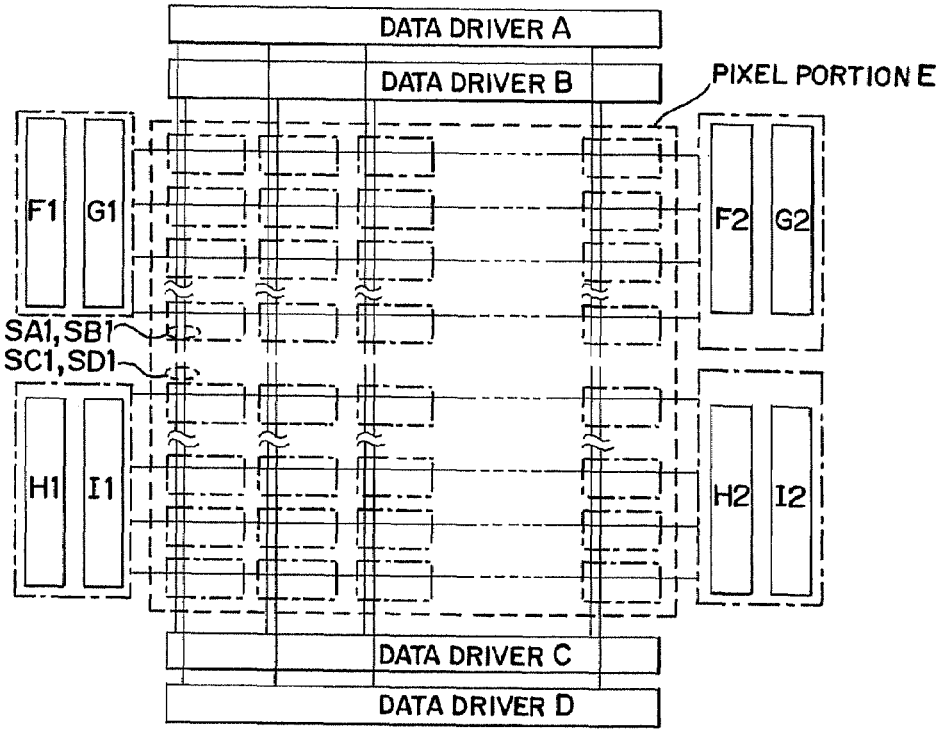
FIGS. 13A to 13C are circuit diagrams of pixel portion and pixels.

Four structural examples of the pixel portion E are given here, and a first structure is described with reference to FIG. 13A. In FIG. 13A, the pixel portion E has a plurality of pixels arranged into a matrix pattern. Two data lines run through each pixel in the column direction and one scanning line runs through each pixel in the row direction. In this mode, the pixel portion is horizontally divided in half and the upper half of the screen has data lines SA and SB whereas the lower half of the screen has data lines SC and SD. The pixel connected to the data line SA is denoted by E-1. The pixel connected to the data line SB is denoted by E-2. The pixel connected to the data line SC is denoted by E-3. The pixel connected to the data line SD is denoted by E-4. This means that the pixel E-1, the pixel E-2, the pixel E-3, and the pixel E-4 are controlled by the data driver A, the data driver B, the data driver C, and the data driver D, respectively.

The scanning drivers F1 to I1 are placed to the left of the screen whereas the scanning drivers F2 to I2 are placed to the right of the screen. The pixel E-1 is selected by the scanning drivers F1 and F2 from both the left and right sides of the screen. The rest of the pixels, E-2 to E-4, are selected in a similar way.

It is not always necessary to place a scanning driver on each side of the screen. However, putting a scanning driver on each side of the screen increases the pixel selecting speed, compared with the case where a scanning driver is placed on only one side of the screen. It is therefore preferable to place a scanning driver on each side of the screen in particular in a display device that has great load because of its large screen and high resolution.

Having the above structure, the present invention can solve the problem of lack of writing time due to large parasitic capacitance of a wire, which is prominent in a large screen display device.

Now, assume that (i×j) pixels are arranged in the upper half of the pixel portion E while the lower half of the pixel portion E has (n×m) pixels. Then the four pixels E-1 to E-4 are arranged to have coordinates (i, j−1), (i, j), (n, m−1), and (n, m), respectively, and their structure is described with reference to FIGS. 13B and 13C. The circuit structure of the pixels can be freely designed and therefore only a switching element and a light emitting element are shown in each pixel in the drawings.

Figure 13B:
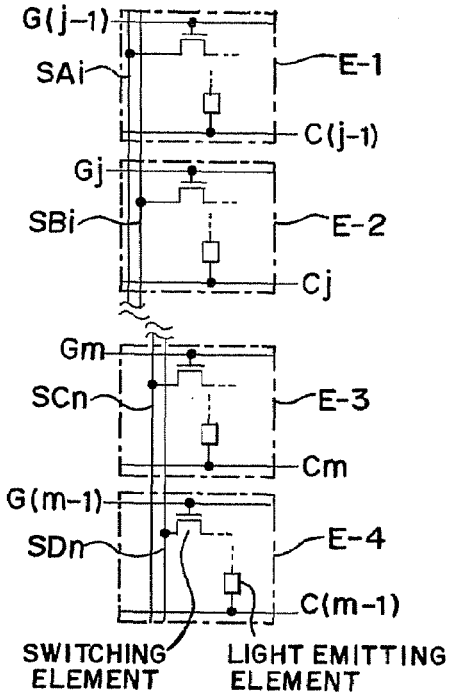
Figure 13C:
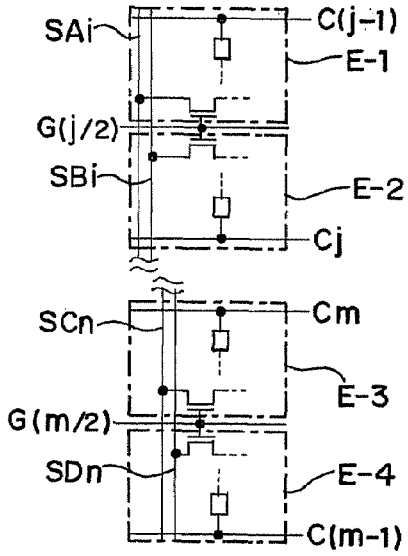

The four pixels in FIG. 13B are separately controlled by the data lines SA to SD and the same applies to the four pixels in FIG. 13C. This makes it possible to simultaneously select four scanning lines $G_{(j-1)}$, $G_j$, $G_{(m-1)}$, and $G_m$, which control the pixels E-1 to E-4. As a result, signals can be written in the four pixels at the same time. This means that signals can be supplied to x pixels simultaneously as opposed to conventional dot sequential driving where a signal is supplied to one pixel at a time. Furthermore, signals can be supplied to (x×n) pixels at once as opposed to conventional linear sequential driving where only n pixels in the first to last (here, the last column is the n-th column) columns receive signals simultaneously. The first structure can thus improve the speed of writing signals in pixels and solve the problem of lack of writing time.

In FIG. 13C, a scanning line is shared by adjacent pixels. The present invention places plural signal lines in one column and allows adjacent pixels to share a scanning line in order to improve the aperture ratio.

Figure 2A:
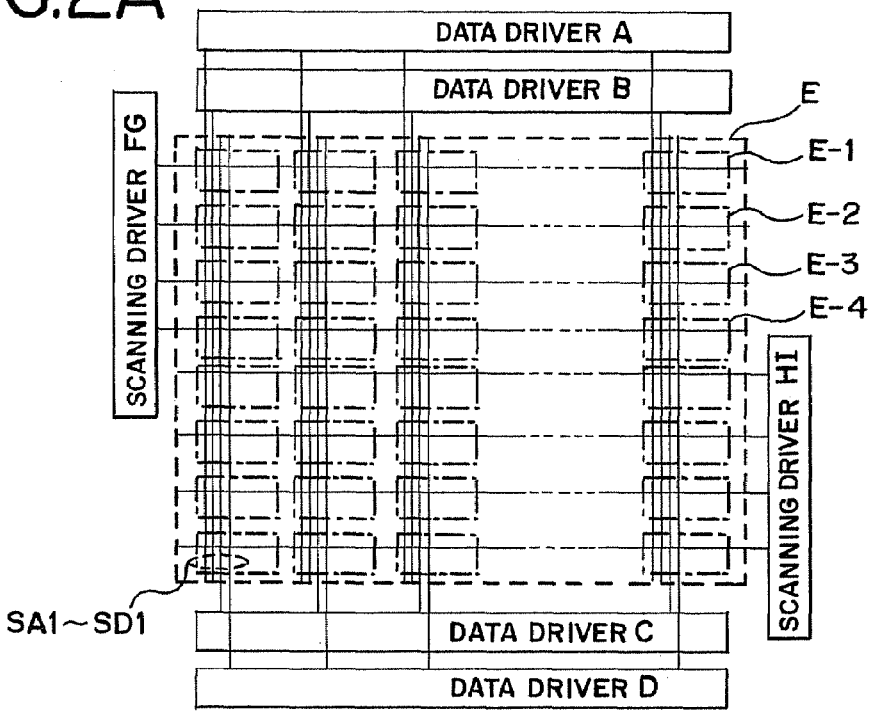
FIGS. 2A to 2C are circuit diagrams of a pixel portion and pixels.
Figure 2B:
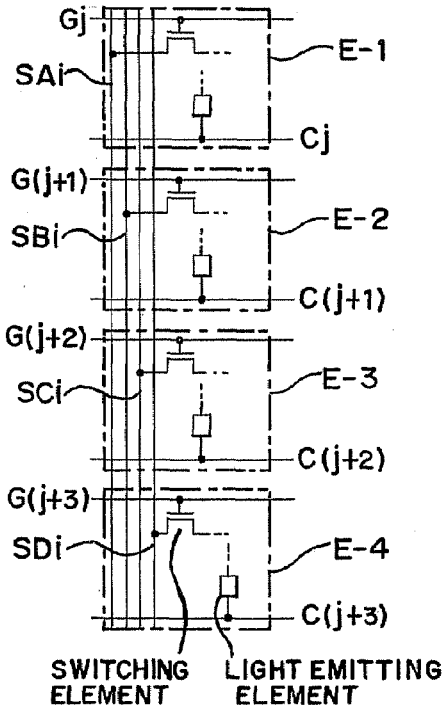
Figure 2C:
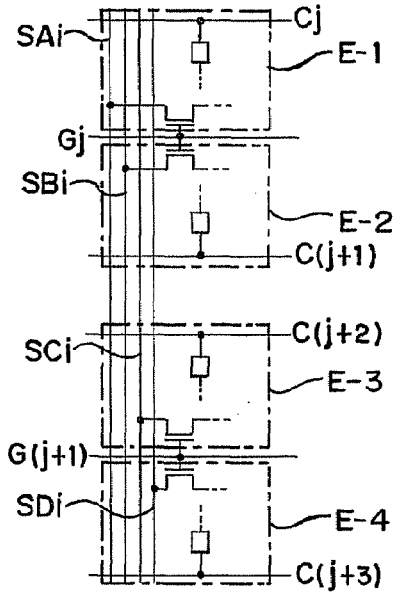

A second structure is described with reference to FIGS. 2A to 2C. In FIGS. 2A to 2C, the pixel portion E has a plurality of pixels arranged into a matrix pattern. Four data lines run through each pixel in the column direction and one scanning line runs through each pixel in the row direction. In this mode, the four data lines arranged in line are denoted by SA to SD. In the same manner as in the above-described mode, the pixel connected to the data line SA is denoted by E-1. The pixel connected to the data line SB is denoted by E-2. The pixel connected to the data line SC is denoted by E-3. The pixel connected to the data line SD is denoted by E-4.

The four pixels E-1 to E-4 are arranged to have coordinates (i, j), to (i, j+3) respectively, and an example of their structure is described with reference to FIGS. 2B and 2C. The four pixels in FIG. 2B are separately controlled by the data lines SA to SD and the same applies to the four pixels in FIG. 2C. This makes it possible to simultaneously select the pixels E-1 to E-4. As a result, signals can be written in the four pixels at the same time.

Figure 8A:
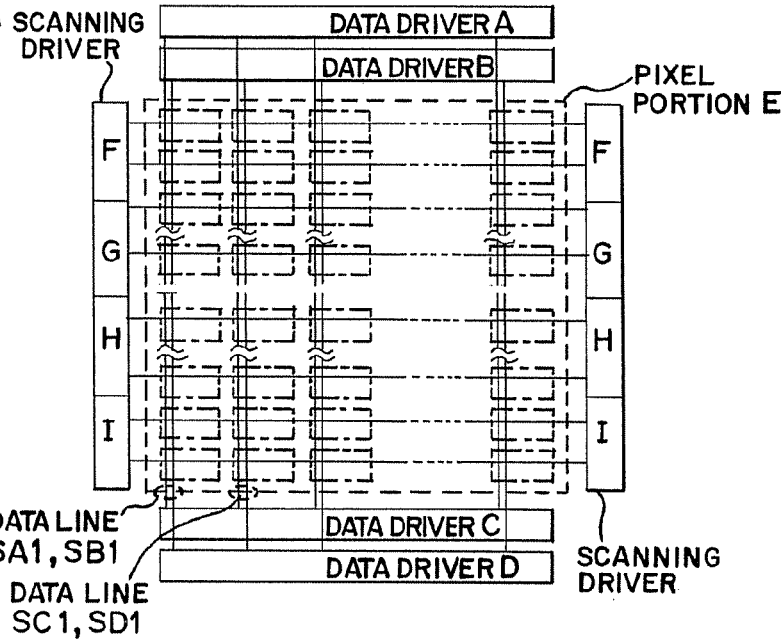
FIGS. 8A to 8C are circuit diagrams of pixel portions.
Figure 8B:
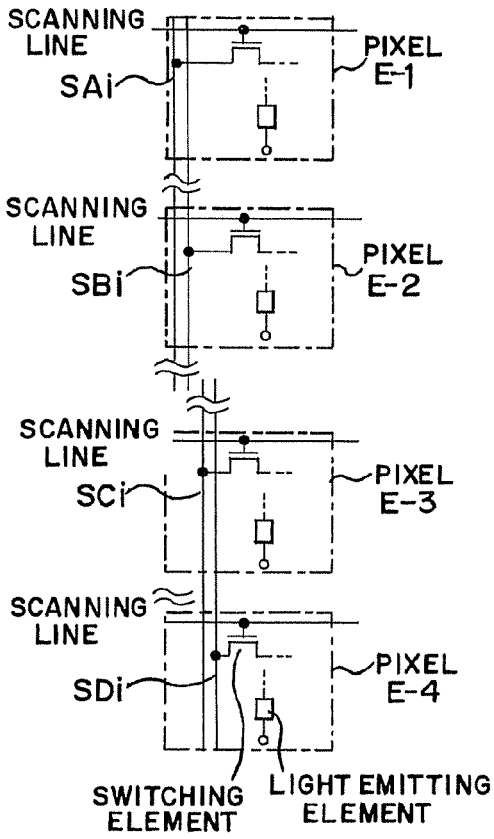
Figure 8C:
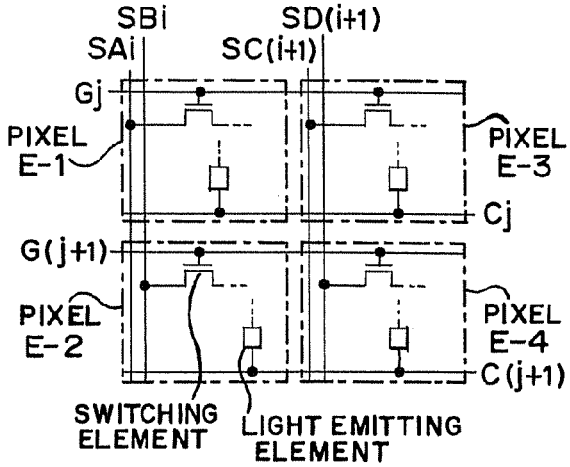

A third structure is described with reference to FIGS. 8A to 8C. In FIGS. 8A to 8C, the pixel portion E has a plurality of pixels arranged into a matrix pattern. Two data lines run through each pixel in the column direction and one scanning line runs through each pixel in the row direction. In this mode, the pixel portion is horizontally divided in half and the upper half of the screen has data lines SA and SB whereas the lower half of the screen has data lines SC and SD.

The data line controlled by the data driver A is denoted by SA. The data line controlled by the data driver B is denoted by SB. The data line controlled by the data driver C is denoted by SC. The data line controlled by the data driver D is denoted by SD. In the same manner as in the first and second modes, the pixel connected to the data line SA is denoted by E-1. The pixel connected to the data line SB is denoted by E-2. The pixel connected to the data line SC is denoted by E-3. The pixel connected to the data line SD is denoted by E-4. This means that the pixel E-1, the pixel E-2, the pixel E-3, and the pixel E-4 are controlled by the data driver A, the data driver B, the data driver C, and the data driver D, respectively.

The structure of the pixels E-1 to E-4 is described with reference to FIGS. 8B and 8C. The four pixels in FIGS. 8B and 8C are separately controlled by the data lines SA to SD and the same applies to the four pixels in FIG. 8C. This makes it possible to simultaneously select the pixels E-1 to E-4. As a result, signals can be written in the four pixels at the same time.

Figure 14A:
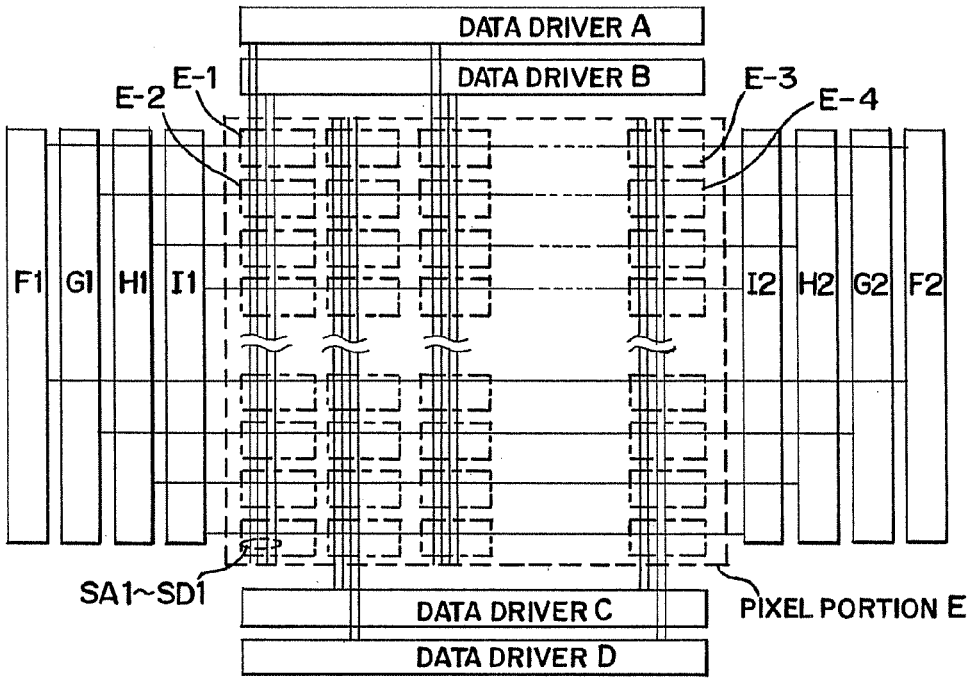
FIGS. 14A to 14C are circuit diagrams of pixel portion and pixels.
Figure 14B:
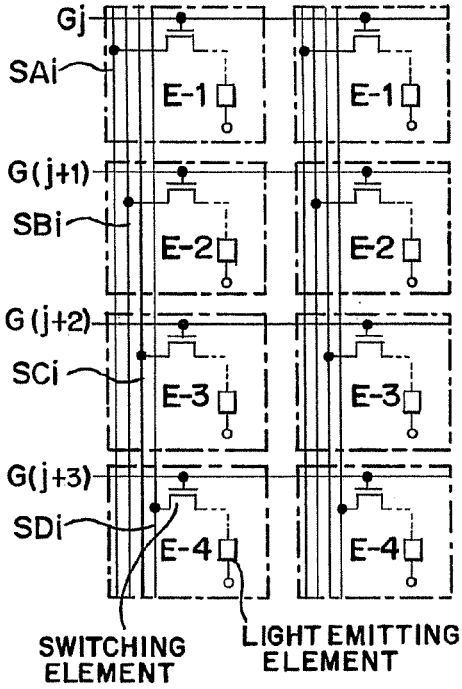
Figure 14C:
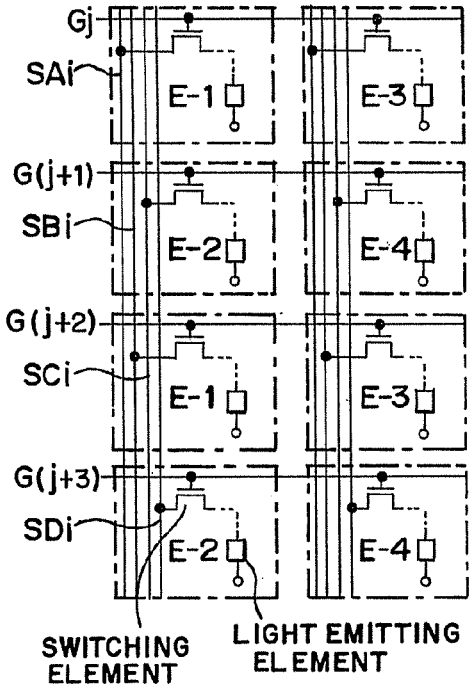

A fourth structure is described with reference to FIG. 14A to 14C. In FIG. 14A to 14C, the pixel portion E has a plurality of pixels arranged into a matrix pattern. Four data lines run through each pixel in the column direction and one scanning line runs through each pixel in the row direction. In this mode, the four data lines arranged in line are denoted by SA to SD. In the same manner as in the above-described modes, the pixel connected to the data line SA is denoted by E-1. The pixel connected to the data line SB is denoted by E-2. The pixel connected to the data line SC is denoted by E-3. The pixel connected to the data line SD is denoted by E-4. This means that the pixel E-1, the pixel E-2, the pixel E-3, and the pixel E-4 are controlled by the data driver A, the data driver B, the data driver C, and the data driver D, respectively.

The structure of the pixels E-1 to E-4 is described with reference to FIGS. 14B and 14C. The four pixels E-1 to E-4 in FIG. 14B are separately controlled by the data lines SA to SD and the same applies to the four pixels in FIG. 14C. This makes it possible to simultaneously select the pixels E-1 to E-4. As a result, signals can be written in the four pixels at the same time.

Figure 9A:
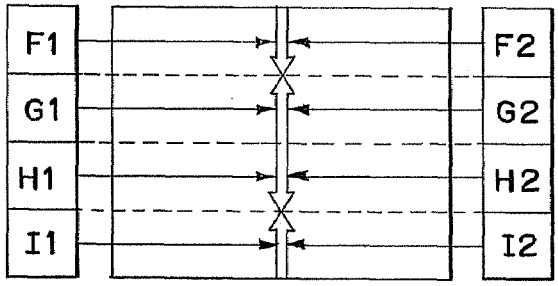
FIGS. 9A to 9C show a driving method.
Figure 9B:
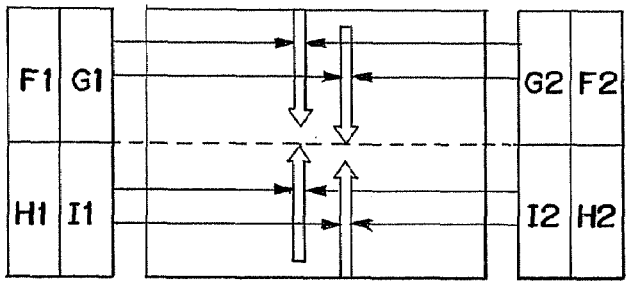
Figure 9C:
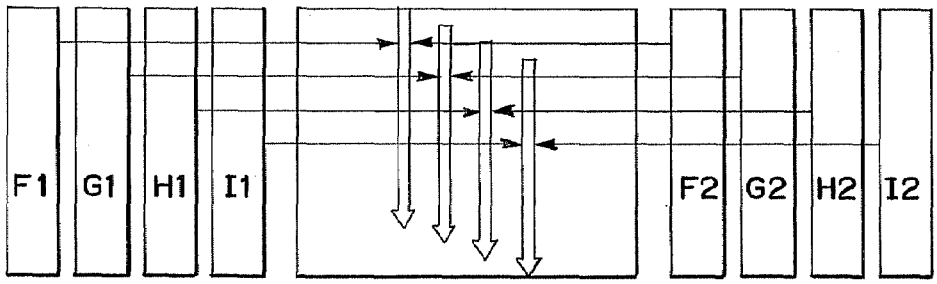

The descriptions given next with reference to FIGS. 9A to 9C are about scanning method examples for the above first to fourth structures. FIG. 9A illustrates a scanning method for the third structure shown in FIGS. 8A to 8C. FIG. 9B illustrates a scanning method for the first structure shown in FIGS. 13A to 13C. FIG. 9C illustrates a scanning method for the second and fourth structures shown in FIGS. 2A to 2C and FIGS. 14A to 14C, respectively.

In the first structure shown in FIGS. 13A to 13C, the pixel portion is roughly divided into two regions, from the first row to the m/2-th row and from the (m/2+1)-th row to the last row (here, the m-th row). Of pixels on the first to m/2-th rows, pixels that are placed on the odd-numbered rows are controlled by the scanning drivers F whereas pixels that are on the even-numbered rows are controlled by the scanning drivers G. Of pixels on the (m/2+1)-th to last rows, pixels that are placed on the odd-numbered rows are controlled by the scanning drivers H whereas pixels that are on the even-numbered rows are controlled by the scanning drivers I. The scanning drivers F scan the pixels starting from the first row toward the m/2-th row. At the same time, the scanning drivers G scan the pixels starting from the first row toward the m/2-th row.

In the second and fourth structures shown in FIGS. 2A to 2C and FIGS. 14A to 14C, respectively, the plural pixels are roughly divided into ones that are on the m-th row, ones on the (m+1)-th row, ones on the (m+2)-th row, and ones on the (m+3)-th row. The pixels on the m-th row are controlled by the scanning driver F. The pixels on the (m+1)-th row are controlled by the scanning driver G. The pixels on the (m+2)-th row are controlled by the scanning driver H. The pixels on the (m+3)-th row are controlled by the scanning driver I.

In the third structure shown in FIGS. 8A to 8C, the pixel portion from the first row to the last row (here, the m-th row) is roughly divided into four regions. Pixels on the first row to the m/4-th row are controlled by the scanning drivers F. Pixels on the (m/4+1)-th row to the m/2-th row are controlled by the scanning drivers G. Pixels on the (m/2+1)-th row to the (3×m)/4-th row are controlled by the scanning drivers H. Pixels on the {(3×m)/4+1}-th row to the last row are controlled by the scanning drivers I. In other words, the pixels on the first to m/4-th rows are scanned by the scanning drivers F and, at the same time, the pixels on the (m/4+1)-th to the m/2-th rows are scanned by the scanning drivers G. The pixels on the (m/2+1)-th to the (3×m)/4-th rows are scanned by the scanning drivers H. The pixels on the {(3×m)/4+1}-th to the last rows are scanned by the scanning drivers I.

Next, an example of the structure of the data drivers will be described. The description takes the data driver A as an example and reference is made to FIGS. 3A to 3E. The data driver is divided into several regions, which operate in tandem with each other. Here, the data driver is divided into eight regions, A-1 to A-8. When the number of pixels is large enough to reach the level of color SXGA, (160×RGB) data lines are connected to each of A-1 to A-8.

For dot sequential driving, the data drivers A-1 to A-8 are each provided with shift registers SR1 to SR40 and sampling circuits SMP1 to SMP40. For linear sequential driving, the data drivers A-1 to A-8 are each provided with shift registers SR1 to SR40, first latches L1-1 to L1-40, and second latches L2-1 to L2-40. When the number of pixels is on the SXGA level, (4×RGB) data lines are connected to each of SMP1 to SMP40.

Figure 3A:
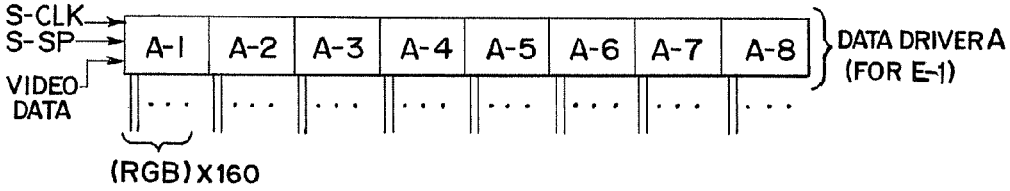
FIGS. 3A to 3E show data drivers.
Figure 3B:
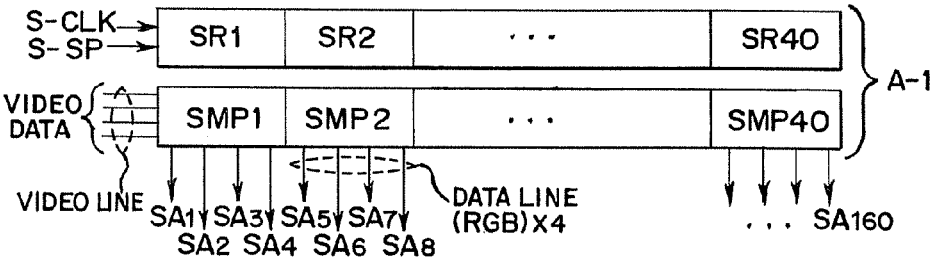

Now, the operation of the data driver in FIG. 3B will be described briefly. This data driver is for dot sequential driving and is suitable for analog driving in which a video signal is of voltage value type. The shift registers SR1 to SR40 are each composed of plural columns of flip flop circuits (FF), decoders, and others. In timing with input of clock (S-CLK) and start pulses (S-SP), the shift registers sequentially output sampling pulses and supply them to the sampling circuits SMP1 to SMP40. Video signals are inputted to the sampling circuits SMP1 to SMP 40. Upon receiving the sampling pulses, video signals inputted to the sampling circuits SMP1 to SMP40 are outputted to data lines $SA_1$ to $SA_{160}$.

Figure 3C:
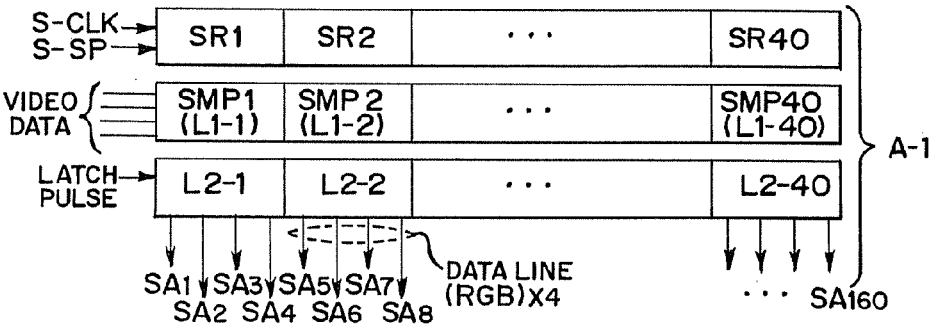
Figure 3D:
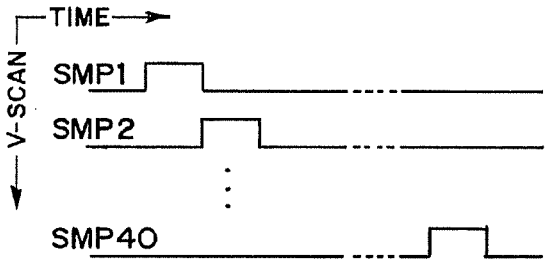

Next, a brief description is given on the operation of the data driver of FIG. 3C. This data driver is for linear sequential driving and is suitable for digital time-division driving. As described above, the shift registers sequentially output sampling pulses and supply them to the sampling circuits SMP1 to SMP40 (the first latches L1-1 to L1-40). Video signals are inputted to the sampling circuits SMP1 to SMP 40. Upon receiving the sampling pulses, each column holds the video signals. As holding video signals is completed for the first to the last columns in the sampling circuits SMP1 to SMP40, latch pulses are inputted to the second latches L2-1 to L2-40 during the horizontal retrace period and the video signals that have been kept in the first latches L1-1 to L1-40 are transferred to the second latches L2-1 to L2-40 at once. Then one line of video signals out of video signals that have been kept in the second latches L2-1 to L2-40 are simultaneously inputted to the data lines $SA_1$ to $SA_{160}$ through the sampling circuits SMP1 to SMP40. While the video signals kept in the second latches L2-1 to L2-40 are inputted to the data lines $SA_1$ to $SA_{160}$, the shift registers SR1 to SR40 again output sampling pulses. The operation is repeated.

FIG. 3C is a timing chart of the sampling circuits SMP1 to SMP40. As shown in FIG. 3C, video signals are simultaneously inputted to the plural data lines placed in each of SMP1 to SMP40.

When the pixel number is on the SXGA level and 15 sub-frames are provided in time-division driving as in this embodiment mode, one horizontal scanning period can be 4 μsec or longer with the data driver clock frequency set to 5 MHz and it is fully fit for practical use.

Figure 3E:
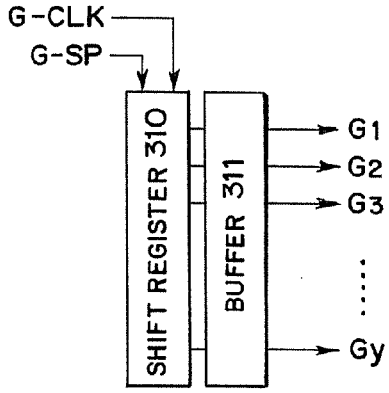

The description given next with reference to FIG. 3E is an example of the scanning line drivers. This scanning driver has a shift register 310 and a buffer 311. To describe its operation briefly, the shift register 310 sequentially outputs sampling pulses as the shift registers described above. The sampling pulses are amplified by the buffer 311 and then inputted to the scanning lines to select the scanning lines one row at a time. Video signals are sequentially written from data lines in pixels that are controlled by the selected scanning lines. A level shifter may be provided between the shift register 310 and the buffer 311. If the scanning driver has a level shifter, the voltage amplitude of the logic circuit portion and the buffer portion can be changed.

Having the above structure, the present invention provides a display device and its driving method free from lack of writing time, which usually accompanies an increase in size of a display device and enhancement in definition. Specifically, the present invention provides a display device and its driving method free from lack of writing time, which is prominent when a current value type signal is used in digital time-division driving or in analog driving.

Embodiment Mode 2

Figure 10A:
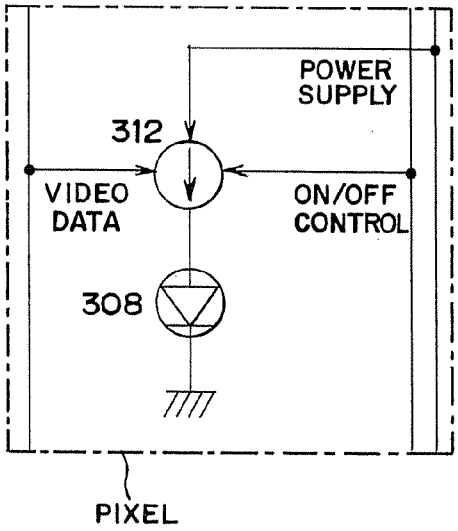
FIGS. 10A to 10D show pixel diagrams.

Referring to FIGS. 4A and 4B and FIGS. 10A to 10D, this embodiment mode gives typical structural examples of the structure of the pixel on the i-th column and the j-th row in a pixel portion E. FIG. 10A is a general expression of a pixel circuit. Specific pixel circuit diagrams can be found in FIGS. 4A and 4B if a video signal of voltage value type is used and in FIGS. 10B to 10D if a video signal of current value type is employed.

Figure 4A:
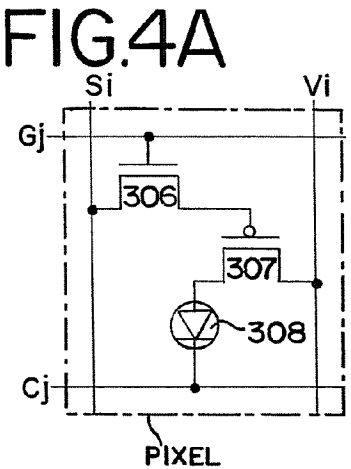
FIGS. 4A to 4E are diagrams of pixel circuits and timing charts showing a driving method.
Figure 4B:
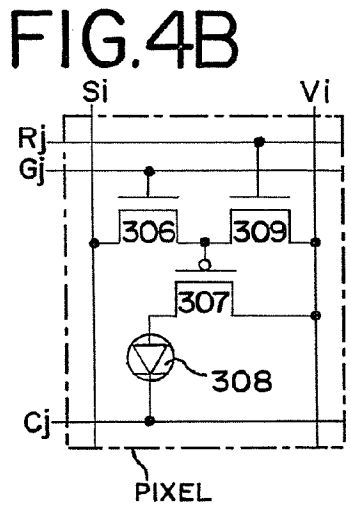

In FIGS. 4A and 4B, a switching transistor 306 has a gate electrode connected to a scanning line $G_j$, a first source drain electrode connected to a signal line $S_i$, and a second source drain electrode connected to a gate electrode of a driving transistor 307. The driving transistor 307 has a first source drain electrode connected to a power supply line $V_i$ and a second source drain electrode connected to one of electrodes of a light emitting element 308. The other electrode of the light emitting element 308 is connected to a power supply line $C_j$.

In FIG. 4B, the switching transistor 306 and an erasing transistor 309 are connected in series to each other and placed between a signal line $S_i$ and a power supply line $V_i$. A gate electrode of the erasing transistor 309 is connected to a scanning line $R_j$. Here, the electrode of the light emitting element 308 that is connected to the second source drain electrode of the driving transistor 307 is called a pixel electrode and the other electrode of the light emitting element 308 that is connected to the power supply line $C_j$ is called an opposite electrode.

In FIGS. 4A and 4B, the switching transistor 306 has a function of controlling input of a video signal to a pixel. The conductivity type of the switching transistor 306 is not particularly limited since it only has to have the function of a switch; the switching transistor 306 can be both an n-channel transistor and a p-channel transistor.

In FIGS. 4A and 4B, the driving transistor 307 has a function of controlling light emission of the light emitting element 308. The conductivity type of the driving transistor 307 is not particularly limited. However, when the driving transistor 307 is a p-channel transistor, it is preferable to use the pixel electrode as an anode and the opposite electrode as a cathode. On the other hand, when the driving transistor 307 is an n-channel TFT, the pixel electrode preferably serves as the cathode while the opposite electrode serves as the anode.

In FIG. 4B, the erasing transistor 309 has a function of stopping light emission of the light emitting element 308. The conductivity type of the erasing transistor 309 is not particularly limited since it only has to have the function of a switch.

In each of the pixels shown in FIGS. 4A and 4B, a voltage value type signal is inputted to the gate electrode of the driving transistor 307 and the drain current of the driving transistor 307 is supplied to the light emitting element 308.

Described next is a pixel that has a current supply 312 therein, so that a given amount of current is supplied to the light emitting element 308 from the current supply 312 as shown in FIG. 10A. The current supply 312 receives a video signal from a signal line, a current from a power supply line, and a control signal from a control line.

Figure 10B:
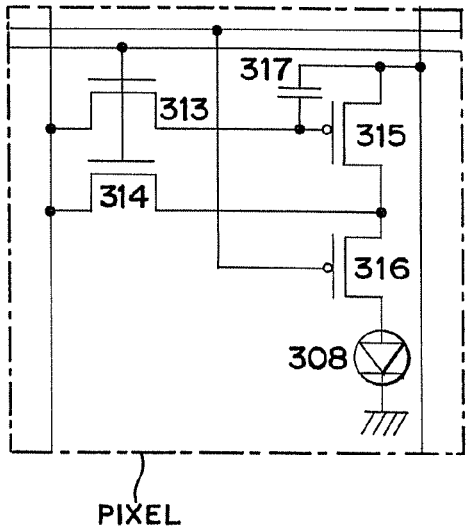

In FIG. 10B, transistors 313 and 314 have a function of controlling input of a signal to the pixel. The gate-source voltage of a transistor 315 is kept at a given level by a capacitor element 317; therefore, a given amount of drain current flows in the transistor 315. A transistor 316 controls conduction between the light emitting element 308 and the transistor 315 and, when the transistor 316 is turned ON, the drain current of the transistor 315 is supplied to the light emitting element 308. The circuit in FIG. 10B is advantageous in that a signal current inputted to the pixel can be reproduced precisely using the transistor 315 to be supplied to the light emitting element 308. However, the circuit also has a drawback of being incapable of supplying the light emitting element with a current of different current value from the signal current.

Figure 10C:
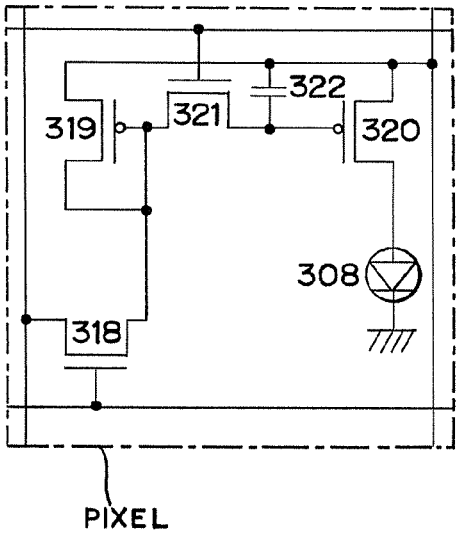

In FIG. 10C, a transistor 318 has a function of controlling input of a signal to the pixel. Transistors 319 and 320 constitute a current mirror circuit. The gate-source voltage of the transistors 319 and 320 is kept at a given level by a capacitor element 322; therefore, a given amount of drain current flows in the transistors 319 and 320. A transistor 321 is placed between a gate of the transistor 320 and a drain of the transistor 319. The circuit of FIG. 10C is advantageous in that the ratio of a current supplied to the light emitting element 308 to the signal current can be set freely by changing the size ratio of the transistor 319 to the transistor 320. However, the circuit also has a drawback; if the transistors 319 and 320 have different characteristics, a current supplied by the transistor 320 to the light emitting element 308 is varied from one pixel to another causing a recognizable display unevenness.

Figure 10D:
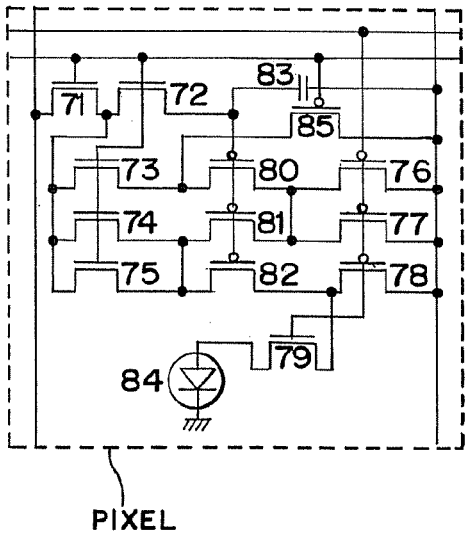

In FIG. 10D, transistors 71 to 75 have a function of controlling input of a signal to the pixel. When a signal is written in the pixel, the transistors 71 to 75 and transistors 76 to 78 are turned ON whereas transistors 79 and 85 are turned OFF. On the other hand, to supply a current to the light emitting element 84, the transistors 71 to 78 are turned OFF while the transistors 79 and 85 are turned ON. The circuit in FIG. 10D has both the advantages of the circuits of FIGS. 10B and 10C.

The transistors placed in the pixel can have, in addition to a single gate structure which has one gate electrode, a multi-gate structure such as a double gate structure with two gate electrodes or a triple gate structure with three gate electrodes. In addition, the transistors can either have a top gate structure in which a gate electrode is placed above a semiconductor or a bottom gate structure in which a gate electrode is placed below a semiconductor. In the pixels of FIGS. 4A and 4B, the capacitor element is not shown since the capacitive coupling between the source and gate of the transistor 307 is large. However, the present invention is not limited thereto and the pixel may have a capacitor element for keeping the gate-source voltage of the transistor 307. The light emitting element 308 has an anode, a cathode, and a light emitting layer, which is sandwiched between the anode and the cathode. The light emitting layer is formed from one or more materials chosen from organic materials, carbon nanolite or other inorganic materials, bulk materials, and the like.

The power supply line $V_i$ may be shared by adjacent pixels: there is no need to provide a power supply line in each column, and adjacent columns can share one power supply line. Since plural signals lines are placed in one column in the present invention, sharing a power supply line between adjacent columns is effective in improving the aperture ratio.

However, in a display device conducting color display, respective pixels corresponding to respective colors of RGB may differ in their luminances, even if the same voltage is applied to them, because of differences in current densities among the respective RGB materials or differences in transmittances among color filters. Therefore, in this case, power supply lines corresponding to the respective colors are provided so that the electric potentials for the respective colors can be set separately. It should be note that, in the present invention, a set of RGB is not called one pixel, but each of the R, G, and B is called one pixel.

Figure 4C:
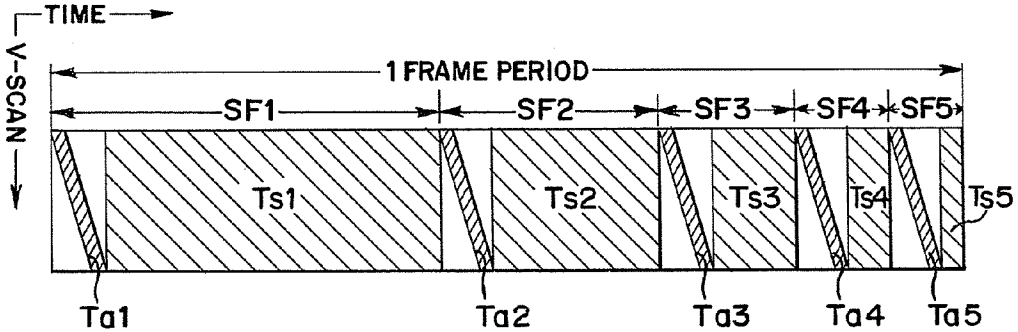
Figure 4D:
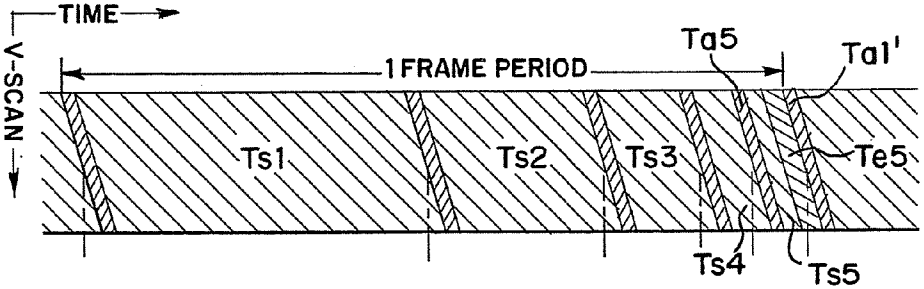
Figure 4E:
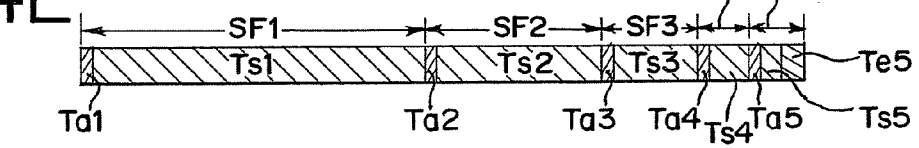

Next, a description of the operation when time-division driving is applied to a display device of the present invention is given with reference to FIGS. 4C to 4E. In the timing charts in FIGS. 4C to 4E, the axis of abscissas shows time and the axis of ordinates shows scanning lines.

In time-division driving, one frame period is divided into plural sub-frame periods SF. Each of the sub-frame periods SF has a writing period Ta and a display period Ts, or a writing period Ta, a display period Ts, and an erasure period Te.

Only some of the sub-frame periods SF where a display period Ts is shorter than a writing period Ta can have an erasure period Te. This is to prevent the next writing period Ta from starting immediately after the display period Ts is ended. If the next writing period Ta is started immediately after completion of the display period Ts, two scanning lines are simultaneously selected, which makes it impossible to input a correct signal to a pixel from a signal line.

In time-division driving, the sub-frame periods SF are different from one another in length of light emission period, and gray scale display is obtained by choosing light emission or non-light emission for each of the sub-frame periods SF and by varying the combination. In the example shown in FIGS. 4C to 4E, the gray scale number is set to 5-bit and one frame period is divided into five sub-frame periods, SF1 to SF5. Lengths of display periods Ts1 to Ts5 of the sub-frame periods SF1 to SF5 are set in accordance with power of 2, so as to satisfy Ts1:Ts2:Ts3:Ts4:Ts5=16:8:4:2:1. Multi-gray scale display is thus obtained. To generalize, n-bit gray scale display is obtained by setting the ratio of lengths of display periods Ts1 to Tsn to $2^{(n-1)}:2^{(n-2)}:\ldots:2^1:2^0$. A writing period Ta is a period for writing digital video signals in pixels and the sub-frame periods SF are equal to one another in length of writing period. A display period Ts is a period in which a pixel emits light or does not emit light as a video signal written in the pixel instructs.

A description is given on a pixel operation in the above writing period Ta, display period Ts, and erasure period Te taking the pixel of FIG. 4B as an example.

First, in the writing period Ta, a pulse is inputted to the scanning line Gj to set the scanning line Gj to the H level and turn the switching transistor 306 ON. This enables the gate electrode of the driving transistor 307 to receive a digital video signal that has been outputted to the signal line Si.

Next, in the display period Ts, the driving transistor 307 is turned ON and the electric potential difference between the power supply line $V_i$ and the power supply line $C_j$ causes a current to flow into the light emitting element 308. Receiving the current, the light emitting element 308 emits light. If the driving transistor 307 remains turned OFF during the display period Ts, no current flows into the light emitting element 308 and the light emitting element 308 does not emit light.

Then, in the following erasure period Te, a pulse is inputted to the scanning line Rj to set the scanning line Rj to the H level and turn the erasing transistor 309 ON. As the erasing transistor 309 is turned ON, the gate-source voltage of the driving transistor 307 is set to zero to turn the driving transistor 307 OFF. This cuts the current supply to the light emitting element 308 and the light emitting element 308 stops emitting light. The erasure period Te is provided in the sub-frame period SF5 alone. This is because the sub-frame period SF5 has the display period Ts5, which is shorter than the writing period Ta5, and it is necessary to prevent the next writing period from starting immediately after completion of the display period Ts5.

The sub-frame periods SF1 to SF5 are started in this order in the timing charts of FIGS. 4C to 4E, but the present invention is not limited thereto. Random order may be employed for the sub-frame periods. It is also possible to divide an arbitrary sub-frame period, and place the divided periods apart from one another in order to reduce display disturbances such as pseudo contour.

Having the above structure, the present invention provides a display device and its driving method free from lack of writing time, which usually accompanies an increase in size of a display device and enhancement in definition. Specifically, the present invention provides a display device and its driving method free from lack of writing time, which is prominent when a current value type signal is used in digital time-division driving or in analog driving.

This embodiment mode can be combined with Embodiment Mode 1 arbitrarily.

Embodiment Mode 3

Figure 5:
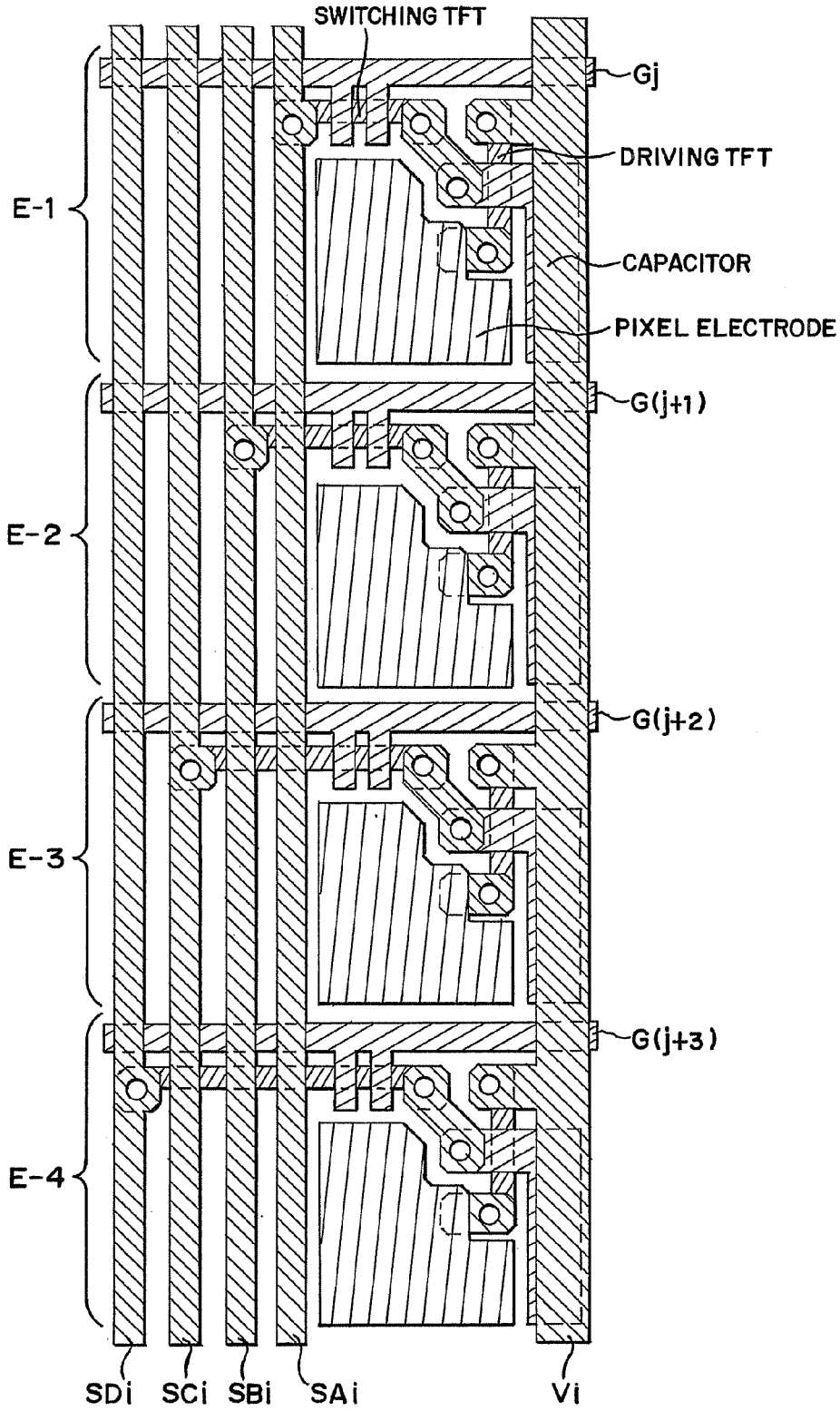
FIG. 5 is a mask layout for pixels.

This embodiment mode gives a description on a top view in FIG. 5 which shows a pixel layout for when the circuit of FIG. 4A is used in the mode illustrated in FIGS. 2A to 2C.

In FIG. 5, there are four pixels, E-1 to E-4, and data lines SAi to SDi are arranged in a column direction whereas scanning lines $G_j$ to $G_{(j+3)}$ are arranged in a row direction. Each pixel has a switching TFT, a driving TFT, and a capacitor. A light emitting element connected to the driving TFT is a laminate of a pixel electrode, a light emitting layer, and an opposite electrode. Of the components of the light emitting element, the pixel electrode alone is shown in FIG. 5.

The switching TFT serves as a double gate transistor. However, the present invention is not limited thereto and the switching TFT may be a single gate transistor or a multi-gate transistor having three or more gate electrodes. In the drawing, the capacitor as a measure to hold the gate-source voltage of the driving TFT is formed from a power supply line, a metal body formed from the same film as the gate electrode, and an insulator placed between the supply line and the metal body. It is unnecessary to provide another capacitor therein when the gate-source voltage of the driving TFT can be held by the gate capacitance and channel capacitance of the driving TFT itself, or by parasitic capacitance of a wire or others.

This embodiment mode can be combined with Embodiment Mode 1 or 2 arbitrarily.

Embodiment Mode 4

Electronic appliances to which the present invention is applied include, for example, video cameras, digital cameras, goggle type displays (head mount displays), navigation systems, audio reproducing devices (such as car audio and audio components), laptop personal computers, game machines, mobile information terminals (such as mobile computers, mobile phones, portable game machines, and electronic books), and image reproducing devices provided with a recording medium (specifically, devices for reproducing a recording medium such as a digital versatile disc (DVD), which includes a display capable of displaying images). Practical examples thereof are shown in FIGS. 6A to 6H.

Figure 6A:
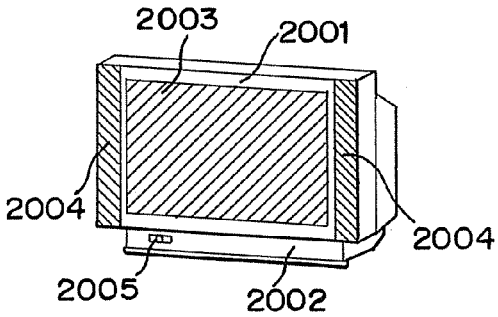
FIGS. 6A to 6H show electronic appliances to which the present invention is applied.

FIG. 6A shows a light emitting device, which contains a casing 2001, a support base 2002, a display portion 2003, a speaker portion 2004, a video input terminal 2005, and the like. The present invention can be applied to the display portion 2003. Further, the light emitting device shown in FIG. 6A is completed with the present invention. Since the light emitting device is of self-light emitting type, it does not need a back light, and therefore a display portion that is thinner than that of a liquid crystal display can be obtained. Note that light emitting devices include all information display devices, for example, personal computers, television broadcast transmitter-receivers, and advertisement displays.

Figure 6B:
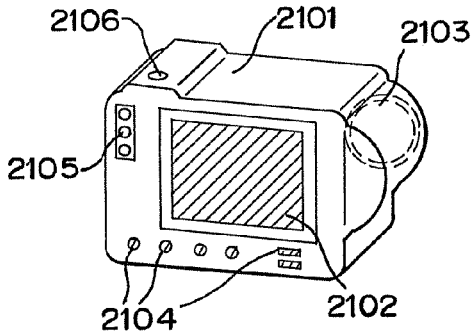

FIG. 6B shows a digital still camera, which contains a main body 2101, a display portion 2102, an image receiving portion 2103, operation keys 2104, an external connection port 2105, a shutter 2106, and the like. The present invention can be applied to the display portion 2102. Further, the digital still camera shown in FIG. 6B is completed with the present invention.

Figure 6C:
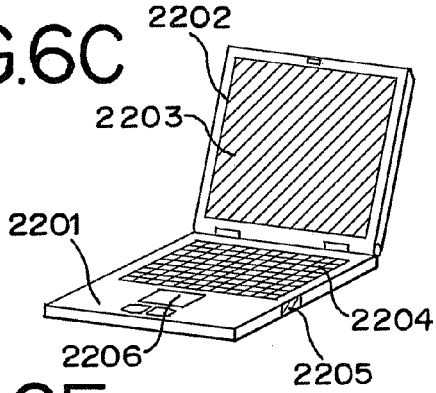

FIG. 6C shows a laptop personal computer, which contains a main body 2201, a casing 2202, a display portion 2203, a keyboard 2204, external connection ports 2205, a pointing mouse 2206, and the like. The present invention can be applied to the display portion 2203. Further, the light emitting device shown in FIG. 6C is completed with the present invention.

Figure 6D:
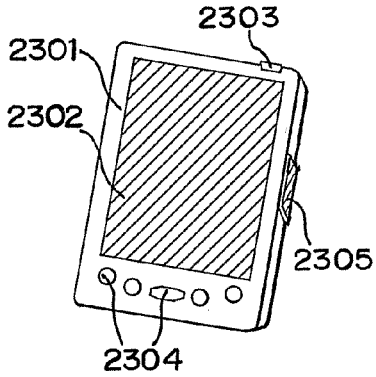

FIG. 6D shows a mobile computer, which contains a main body 2301, a display portion 2302, a switch 2303, operation keys 2304, an infrared port 2305, and the like. The present invention can be applied to the display portion 2302. Further, the mobile computer shown in FIG. 6D is completed with the present invention.

Figure 6E:
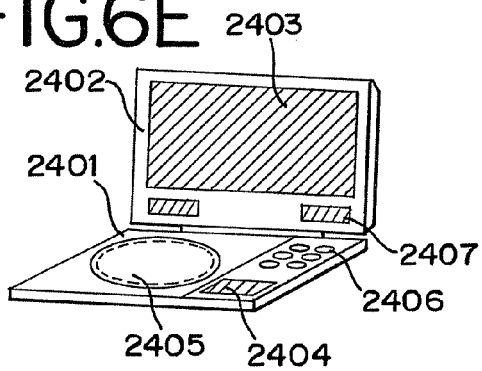

FIG. 6E shows a portable image reproducing device provided with a recording medium (specifically, a DVD reproducing device), which contains a main body 2401, a casing 2402, a display portion A 2403, a display portion B 2404, a recording medium (such as a DVD) read-in portion 2405, operation keys 2406, a speaker portion 2407, and the like. The display portion A 2403 mainly displays image information, and the display portion B 2404 mainly displays character information. The present invention can be used in the display portion A 2403 and in the display portion B 2404. Note that family game machines and the like are included in the image reproducing devices provided with a recording medium. Further, the image display device shown in FIG. 6E is completed with the present invention.

Figure 6F:
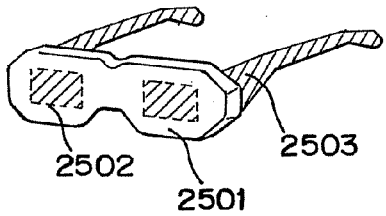

FIG. 6F shows a goggle type display (head mounted display), which contains a main body 2501, a display portion 2502, an arm portion 2503, and the like. The present invention can be used in the display portion 2502. The goggle type display shown in FIG. 6F is completed with the present invention.

Figure 6G:
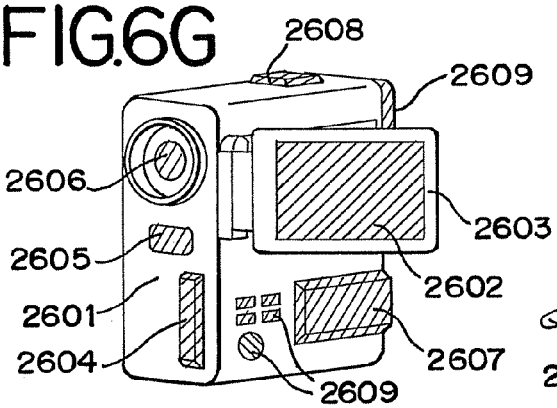

FIG. 6G shows a video camera, which contains a main body 2601, a display portion 2602, a casing 2603, external connection ports 2604, a remote control reception portion 2605, an image receiving portion 2606, a battery 2607, an audio input portion 2608, operation keys 2609 and the like. The present invention can be used in the display portion 2602. The video camera shown in FIG. 6G is completed with the present invention.

Figure 6H:
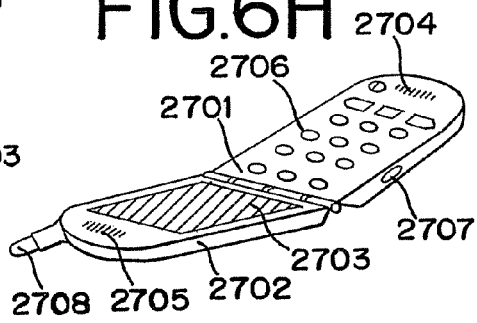
Figure 7:
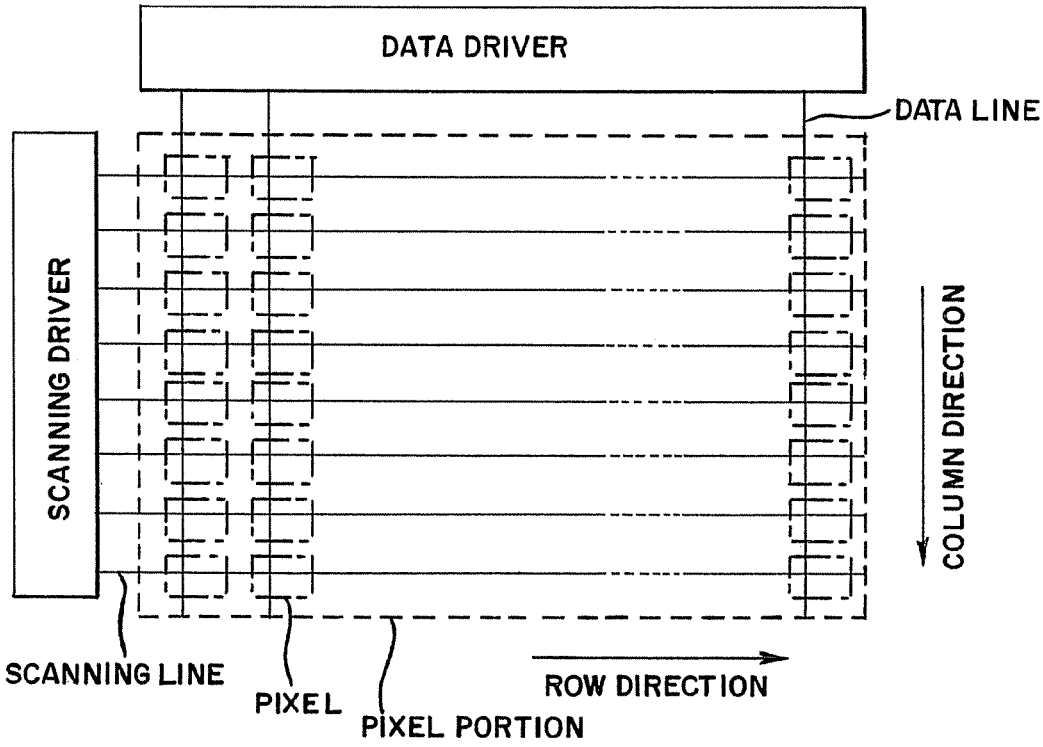
FIG. 7 is a circuit diagram of pixel portion.

Here, FIG. 6H shows a mobile phone, which contains a main body 2701, a casing 2702, a display portion 2703, an audio input portion 2704, an audio output portion 2705, operation keys 2706, external connection ports 2707, an antenna 2708, and the like. The present invention can be used in the display portion 2703. Note that, by displaying white characters on a black background, the current consumption of the mobile phone can be suppressed in the display portion 2703. Further, the mobile phone shown in FIG. 6H is completed with the present invention.

When light emission with the high luminance can be realized in the future due to the development of light emitting materials, the light emitting device will be able to be applied to a front or rear type projector for magnifying and projecting outputted light containing image information by a lens or the like.

Cases are increasing in which the above-described electronic appliances display information distributed via electronic communication lines such as the Internet and CATVs (cable TVs). Particularly, cases where moving picture information is displayed are increasing. Since the response speed of the light emitting materials is very high, the light emitting device is preferably used for moving picture display.

Since the light emitting device consumes power in a light emitting portion, information is desirably displayed so that the light emitting portions are reduced as much as possible.

Thus, in the case where the light emitting device is used for a display portion of a mobile information terminal, particularly, a mobile phone, an audio playback device, or the like, which primarily displays character information, it is preferable that the character information be formed in the light emitting portions with the non-light emitting portions being used as the background.

As described above, the application range of the present invention is very wide, so that the invention can be used for electronic appliances in all of fields. The electronic appliances according to this embodiment mode may use the structure of the light emitting device according to any one of Embodiment Modes 1 to 3.

Embodiment Mode 5

The electronic appliances shown in Embodiment Mode 4 have a module, mounting an IC including a controller, a power supply circuit and the like, mounted on a panel in a state sealed with the light emitting elements. Both the module and the panel correspond to one mode of a display device. Here, explanation is made on a concrete configuration of the module.

Figure 11A:
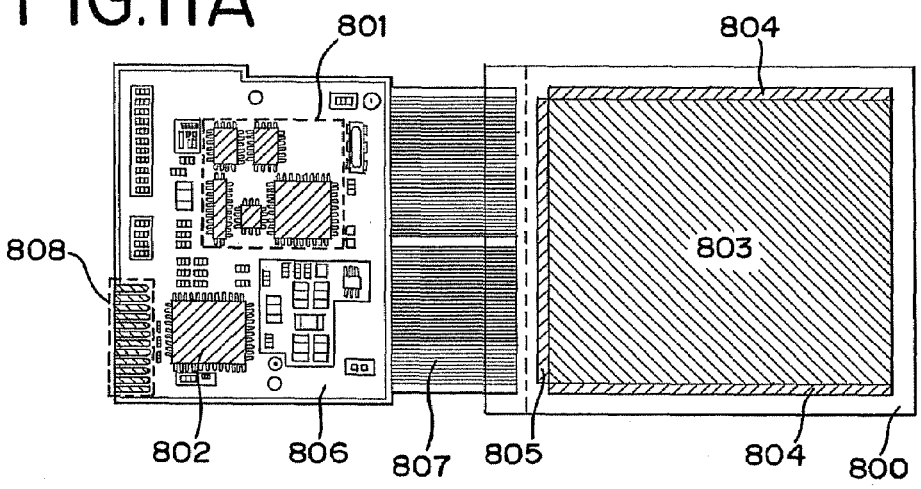
FIG. 11A and FIG. 11B show modules.

FIG. 11A shows an outline view of a module having a controller 801 and power supply circuit 802 mounted on a panel 800. The panel 800 is provided with a pixel portion 803 having light emitting elements on respective pixels, a scanning-line driver circuit 804 for selecting a pixel possessed by the pixel portion 803, and a signal-line driver circuit 805 for supplying a video signal to the selected pixel.

Meanwhile, a printed board 806 is provided with a controller 801 and a power supply circuit 802. The various signals and power supply voltage outputted from the controller 801 or power supply circuit 802 are supplied to the pixel portion 803, the scanning-line driver circuit 804 and the signal-line driver circuit 805 in the panel 800 through an FPC 807.

The power supply voltage and various signals to the printed board 806 are supplied through an interface (I/F) section 808 arranged with a plurality of input terminals.

Incidentally, although, in this embodiment mode, the printed board 806 is mounted on the panel 800 by the use of the FPC, the present invention is not limited to this structure. The COG (chip on glass) method may be used to directly mount the controller 801 and power supply circuit 802 on the panel 800.

Also, on the printed board 806, there is a case that noise be involved in the power supply voltage or signal, or signal rise be blunted, due to the capacitances formed between the lead wirings and the resistances possessed by the wirings themselves. Consequently, various elements such as capacitors and buffers may be provided on the printed board 806, to prevent noise from being involved in the power supply voltage or signal or to prevent signal rise from being blunted.

Figure 11B:
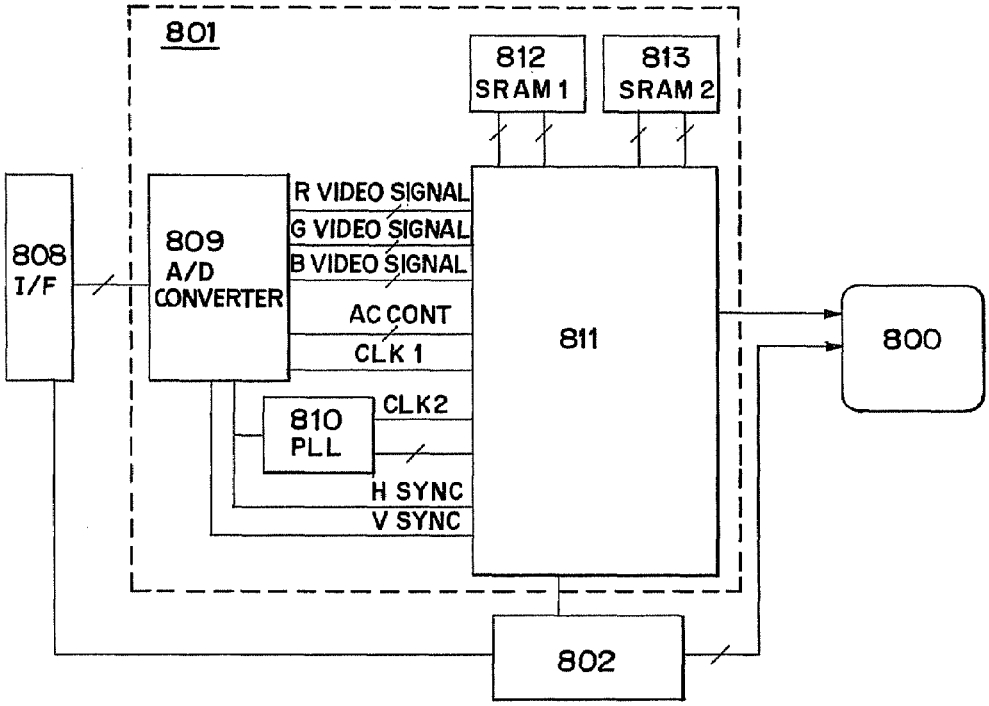

FIG. 11B is a block diagram showing a configuration of the printed board 806. The various signals and power supply voltage supplied to the interface 808 are then supplied to the controller 801 and the power supply circuit 802.

The controller 801 has an analog interface circuit 809, a phase-locked loop (PLL) 810, a control-signal generating portion 811 and SRAMs (static random access memories) 812, 813. Although SRAMs are used in this embodiment mode, it is possible to use SDRAMs or, DRAMs (dynamic random access memories) if it is possible to write in data or read out data at high speed, in place of the SRAMs.

The analog video signal supplied through the interface 808 is A/D-converted and parallel-serial converted in the analog interface circuit 809, thus being inputted as a digital video signal corresponding to the colors of R, G and B to the control-signal generating portion 811. Also, on the basis of the various signals supplied through the interface 808, an Hsync signal, a Vsync signal, a clock signal CLK and the like are generated in the analog interface circuit 809 and inputted to the control signal generating circuit 811. When the digital video signal is directly inputted to the interface 808, there is no need to arrange the analog interface circuit 809.

The phase-locked loop 810 has a function to synchronize the phase of the frequency of various signals supplied through the interface 808 with the phase of the operating frequency of the control-signal generating portion 811. The operating frequency of the control-signal generating portion 811 is not necessarily the same as the frequency of the various signals supplied through the interface 808, but adjust, in the phase-locked loop 810, the operating frequency of the control-signal generating portion 811 in a manner of synchronization with one another.

The video signal inputted to the control-signal generating portion 811 is once written into and held on the SRAM 812, 813. The control-signal generating portion 811 reads out, bit by bit, the video signals corresponding to all the pixels from among all the bits of video signals held on the SRAM 812, and supplies them to the signal-line driver circuit 805 in the panel 800.

The control-signal generating portion 811 supplies the information concerning a period during which the light emitting element of each bit causes light emission, to the scanning-line driver circuit 804 in the panel 800.

The power supply circuit 802 supplies a predetermined power supply voltage to the signal-line driver circuit 805, scanning-line driver circuit 804 and pixel portion 803 in the panel.

Figure 12:
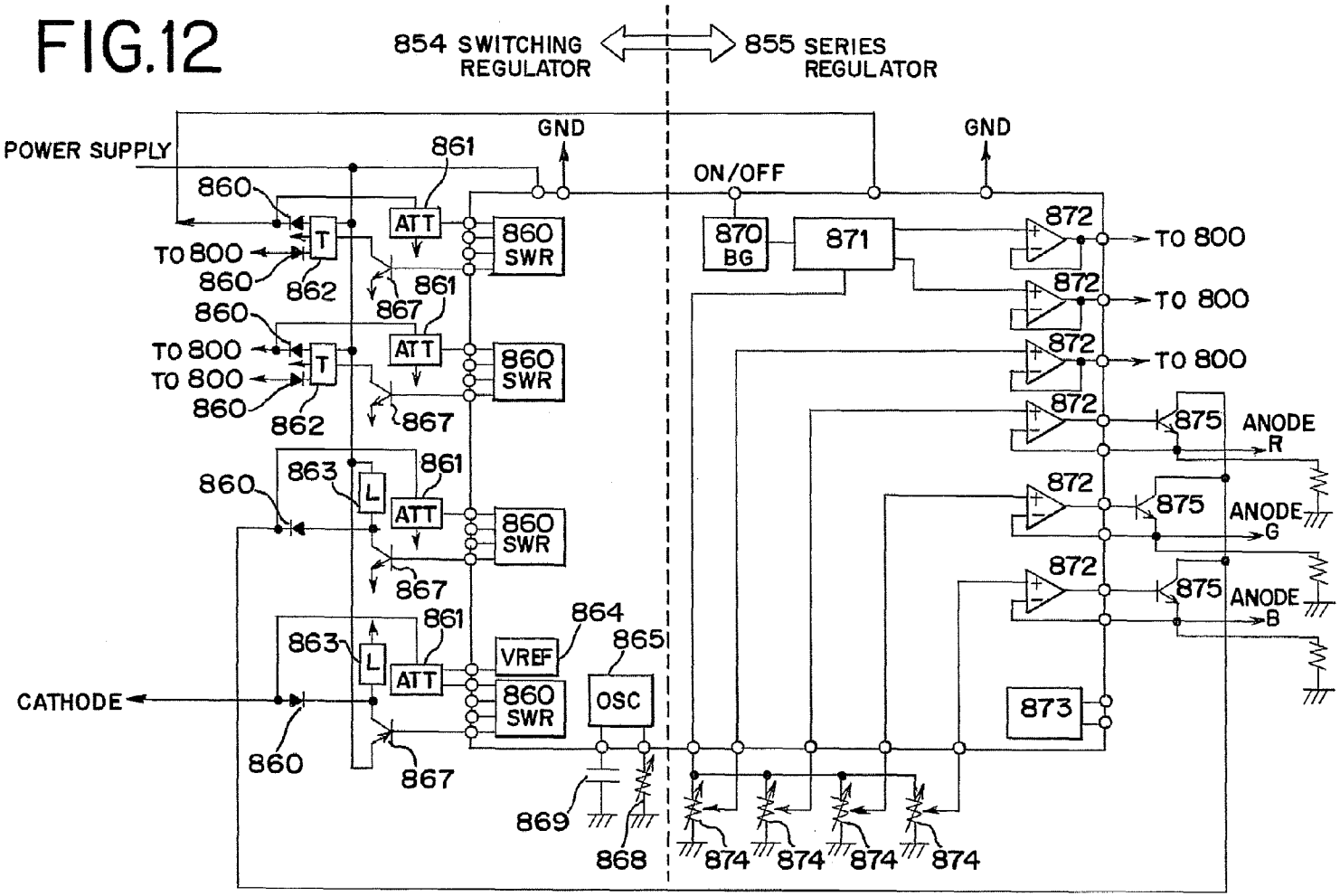
FIG. 12 show a power supply circuit.

Explanation is now made on the configuration of the power supply circuit 802 with reference to FIG. 12. The power supply circuit 802 comprises a switching regulator 854 using four switching regulator controls 860 and a series regulator 855.

Generally, the switching regulator, small in size and light in weight as compared to the series regulator, can raise voltage and invert polarities besides voltage reduction. On the other hand, the series regulator, used only in voltage reduction, has a well output voltage accuracy as compared to the switching regulator, hardly causing ripples or noises. The power supply circuit 802 of this embodiment mode uses a combination of the both.

The switching regulator 854 shown in FIG. 12 has a switching regulator control (SWR) 860, an attenuator (ATT) 861, a transformer (T) 862, an inductor (L) 863, a reference power source (Vref) 864, an oscillator circuit (OSC) 865, a diode 866, a bipolar transistor 867, a varistor 868 and a capacitance 869.

When a voltage of an external Li-ion battery (3.6 V) or the like is transformed in the switching regulator 854, generated are a power supply voltage to be supplied to a cathode and a power supply voltage to be supplied to the switching regulator 854.

The series regulator 855 has a band-gap circuit (BG) 870, an amplifier 871, operational amplifiers 872, a current source 873, a varistor 874 and a bipolar transistor 875, and is supplied with a power supply voltage generated at the switching regulator 854.

In the series regulator 855, a power supply voltage generated by the switching regulator 854 is used to generate a direct current power supply voltage to be supplied to a wiring (current supply line) for supplying current to the anodes of various-color of light emitting elements depending upon a constant voltage generated by the band-gap circuit 870.

Incidentally, the current source 873 is used for a driving method to write video signal current to the pixel. In this case, the current generated by the current source 873 is supplied to the signal-line driver circuit 805 in the panel 800. In the case of a driving method to write the video signal voltage to the pixel, the current source 873 need not necessarily be provided.

The present invention provides a display device and its driving method in which x (x is a natural number equal to or larger than 4) data lines are arranged in each column to simultaneously supply signals to x pixels through each of the x data lines. Further, the present invention makes it possible to simultaneously supply signals to x pixels by arranging a plurality of data drivers that select a data line, as opposed to conventional dot sequential driving where a signal is supplied to one pixel at one time. Furthermore, the present invention makes it possible to supply signals to (x×n) pixels simultaneously, as opposed to conventional linear sequential driving where signals are supplied to n pixels of the first column to the last column.

Having the above structure, the present invention provides a display device and its driving method free from lack of writing time, which usually accompanies an increase in size of a display device and enhancement in definition. Specifically, the present invention provides a display device and its driving method free from lack of writing time, which is prominent when a current value type signal is used in digital time-division driving or in analog driving.

What is claimed is:

1. A display device comprising a plurality of pixels arranged in a pixel portion including a plurality of pixel columns, wherein at least four data lines extend in each one of the pixel columns, and wherein the at least four data lines are connected to different data drivers.

2. The display device according to claim 1, wherein video signals are supplied to the pixels simultaneously though the at least four data lines.

3. A display device comprising:

a plurality of pixels arranged in a pixel portion;

a first pixel and a second pixel arranged in the same column direction in the pixel portion, wherein each of the first pixel and the second pixel comprises a switching transistor and a light emitting element;

a first data line electrically connected to the switching transistor of the first pixel; and a second data line electrically connected to the switching transistor of the second pixel.

4. A display device according to claim 3, wherein the light emitting element comprises an OLED.

5. A display device comprising:

a plurality of pixels arranged in a matrix pattern in a pixel portion, the matrix pattern having a plurality of pixel columns in which the pixels are arranged in a column direction;

a plurality of data lines extending in the column direction; and a plurality of scanning lines extending in a row direction, wherein the pixels each have a light emitting element, wherein at least two data lines out of the plurality of data lines extend in each one of the pixel columns and one scanning line out of the plural scanning lines extends in each one row, wherein at least one scanning driver is provided to select at least two scanning lines out of the plurality of scanning lines simultaneously, and wherein at least two data drivers are provided to simultaneously supply signals to at least two pixels selected out of the plurality of pixels through the at least two data lines extending in each one of the pixel columns.

6. A display device according to claim 5, wherein the at least two data drivers each have a plurality of shift registers and sampling circuits, and the shift registers each operating independently, each of the sampling circuits being associated with one of the shift registers.

7. A display device according to claim 5, wherein the at least two data drivers each have a plurality of shift registers, first latches, second latches, and sampling circuits, the shift registers each operating independently, each of the first latches, each of the second latches, and each of the sampling circuits being associated with one of the shift registers.

8. A display device according to claim 5, wherein the light emitting element comprises an OLED.

9. A display device according to claim 5, wherein the plurality of pixels, the at least one scanning driver, and the at least two data drivers are formed over the same insulator.

10. A display device according to claim 5, wherein the pixels each have a driving transistor, a switching transistor, and a capacitor, the driving transistor controlling a current value of the light emitting element, the switching transistor controlling input of a video signal into its pixel, and the capacitor holding the video signal.

11. A display device according to claim 5, wherein the pixels each have a driving transistor, a switching transistor, a capacitor, and an erasing transistor, the driving transistor controlling a current value of the light emitting element, the switching transistor controlling input of a video signal into its pixel, the capacitor holding the video signal, and the erasing transistor discharging electric charges that are held in the capacitor.

12. A display device comprising:

a plurality of pixels arranged in a matrix pattern in a pixel portion, the matrix pattern having a plurality of pixel columns in which the pixels are arranged in a column direction;

at least two data lines placed in each one pixel column;

one scanning line placed in each one row; and a plurality of pixels placed at portions where the data lines and the scanning line intersect with each other to form a matrix pattern, the pixels each having a light emitting element, wherein at least one scanning driver is provided to select at least two scanning lines out of the plurality of scanning lines simultaneously, and wherein at least two data drivers are provided to simultaneously supply signals to at least two pixels selected out of the plurality of pixels though the at least two data lines extending in each one pixel column.

13. A display device according to claim 12, wherein the at least two data drivers each have a plurality of shift registers and sampling circuits, and the shift registers each operating independently, each of the sampling circuits being associated with one of the shift registers.

14. A display device according to claim 12, wherein the at least two data drivers each have a plurality of shift registers, first latches, second latches, and sampling circuits, the shift registers each operating independently, each of the first latches, each of the second latches, and each of the sampling circuits being associated with one of the shift registers.

15. A display device according to claim 12, wherein the light emitting element comprises an OLED.

16. A display device according to claim 12, wherein the plurality of pixels, the at least one scanning driver, and the at least two data drivers are formed over the same insulator.

17. A display device according to claim 12, wherein the pixels each have a driving transistor, a switching transistor, and a capacitor, the driving transistor controlling a current value of the light emitting element, the switching transistor controlling input of a video signal into its pixel, and the capacitor holding the video signal.

18. A display device according to claim 12, wherein the pixels each have a driving transistor, a switching transistor, a capacitor, and an erasing transistor, the driving transistor controlling a current value of the light emitting element, the switching transistor controlling input of a video signal into its pixel, the capacitor holding the video signal, and the erasing transistor discharging electric charges that are held in the capacitor.

19. A driving method of a display device that has a plurality of pixels arranged in a matrix pattern in a pixel portion, the matrix pattern having a plurality of pixel columns in which the pixels are arranged in a column direction, a plurality of data lines in the column direction, a plurality of scanning lines in a row direction, wherein the pixels each have a light emitting element and a TFT, wherein each of the TFTs is electrically connected to different data lines in the same pixel column, at least two data lines out of the plurality of data lines extending in each one of the pixel columns, and one scanning line out of the plurality scanning lines extending in each one row, comprising the steps of:

dividing one frame period into a plurality of sub-frame periods, dividing each of the plurality of sub-frame periods into a writing period and a light emission period, and in the writing period, selecting two scanning lines simultaneously by at least one scanning driver, and simultaneously supplying signals by the at least two data drivers to at least two pixels selected out of the plurality of pixels through the at least two data lines extending in each one of the pixel columns.

20. A driving method of a display device that has a plurality of pixels arranged in a matrix pattern in a pixel portion, the matrix pattern having a plurality of pixel columns in which the pixels are arranged in a column direction; at least two data lines placed in each one of the pixel columns, one scanning line placed in each one row, and the plurality of pixels placed at portions where the data lines and the scanning line intersect to each other to form the matrix pattern, wherein the pixels each have a light emitting element and a TET, where in the TFTs are electrically connected to different data lines in the same pixel column: comprising the steps of:

dividing one frame period into a plurality of sub-frame periods, dividing each of the plurality of sub-frame periods into a writing period, a light emission period, and an erasure period, and in the writing period, selecting two scanning lines simultaneously by at least one scanning driver, and simultaneously supplying signals by the at least two data drivers to at least two pixels selected out of the plurality of pixels through the at least two data lines extending in each one of the pixel columns.

21. A display device comprising:

a plurality of data lines and a plurality of scanning lines, a plurality of pixels;

at least first and second pixels arranged in the same column direction;

the first pixel comprising:

a first switching transistor;

a first driving transistor;

a first pixel electrode;

the second pixel comprising:

a second switching transistor;

a second driving transistor;

a second pixel electrode wherein a first data line of the plurality of data lines is electrically connected to the first switching transistor;

wherein a second data line of the plurality of data lines is electrically connected to the second switching transistor;

wherein a first scanning line of the plurality of scanning lines is electrically connected to the first switching transistor;

wherein a second scanning line of the plurality of scanning lines is electrically connected to the second switching transistor; and wherein each of the plurality of pixels, the first pixel and the second pixel comprises a light-emitting element.

22. A display device according to claim 21, wherein the light emitting element comprises an OLED.

23. A display device comprising:

a plurality of pixels;

a plurality of data lines;

a plurality of scanning lines;

a first data driver for supplying a video signal to the pixels which are arranged in first to m/2-th rows and in odd-numbered rows;

a second data driver for supplying a video signal to the pixels which are arranged in first to m/2-th rows and in even-numbered rows;

a third data driver for supplying a video signal to the pixels which are arranged in (m/2+1)-th to m-th rows and in odd-numbered rows;

a fourth data driver for supplying a video signal to the pixels which are arranged in (m/2+1)-th to m-th rows and in even-numbered rows;

a first scanning driver for controlling the scanning lines extending in the first to m/2-th rows;

a second scanning driver for controlling the scanning lines extending in the (m/2+1)-th to m-th rows; and at least two data lines of the plurality of data lines extending in each one pixel column.

24. A display device according to claim 23, wherein the first scanning driver and the second scanning driver each includes a shift register and a buffer.

25. A display device according to claim 23, wherein the plurality of pixels, the plurality of data lines, the plurality of scanning lines, the first data driver, the second data driver, the third data driver, the fourth data driver, the first scanning driver and the second scanning driver are formed over the same insulator.

26. A display device according to claim 23, wherein each of the first to fourth data drivers includes a plurality of shift registers which operate independently, a plurality of first latches, a plurality of second latches, and a plurality of sampling circuits.

27. A display device comprising:

a plurality of pixels;

a plurality of data lines;

a plurality of scanning lines;

a first data driver for supplying a video signal to the pixels arranged in a m-th row;

a second driver for supplying a video signal to the pixels arranged in a (m+1)-th row;

a third data driver for supplying a video signal to the pixels arranged in a (m+2)-th row;

a fourth data driver for supplying a video signal to the pixels arranged in a (m+3)-th row;

a first scanning driver for controlling the scanning line extending in the m-th row;

a second scanning driver for controlling the scanning line extending in the (m+1)-th row;

a third scanning driver for controlling the scanning line extending in the (m+2)-th row; and a fourth scanning driver for controlling the scanning line extending in the (m+3)-th row.

28. A display device according to claim 27, wherein each of the first to fourth data drivers includes a plurality of shift registers which operate independently, a plurality of first latches, a plurality of second latches, and a plurality of sampling circuits.

29. A display device according to claim 28, wherein each of the first to fourth data drivers includes a plurality of shift registers which operate independently, a plurality of first latches, a plurality of second latches, and a plurality of sampling circuits.

30. A display device according to claim 28, wherein the first to fourth scanning drivers each includes a shift register and a buffer.

31. A display device according to claim 28, wherein the plurality of pixels, the plurality of data lines, the plurality of scanning lines, the first data driver, the second data driver, the third data driver, the fourth data driver, the first scanning driver and the second scanning driver, the third scanning driver, and the fourth scanning driver are formed over the same insulator.

32. A display device according to claim 27, wherein the first to fourth scanning drivers each includes a shift register and a buffer.

33. A display device according to claim 27, wherein the plurality of pixels, the plurality of data lines, the plurality of scanning lines, the first data driver, the second data driver, the third data driver, the fourth data driver, the first scanning driver and the second scanning driver, the third scanning driver, and the fourth scanning driver are formed over the same insulator.

34. A display device comprising:

a plurality of pixels;

a plurality of data lines;

a plurality of scanning lines;

a first data driver for supplying a video signal to the pixels which are arranged in first to m/4-th rows through the data lines;

a second data driver for supplying a video signal to the pixels which are arranged in (m/4+1)-th rows to m/2-th row through the data lines;

a third data driver for supplying a video signal to the pixels which are arranged in (m/2+1)-th row to 3×m/4-th rows through the data lines;

a fourth data driver for supplying a video signal to the pixels which are arranged in (3×m/4+1-th row to m-th rows through the data lines;

a first scanning driver for controlling the scanning lines extending in the first to m/4-th rows;

a second scanning driver for controlling the scanning lines extending in the (m/4+1)-th row to m/2-th rows;

a third scanning driver for controlling the scanning lines extending in the (m/2+1)-th row to 3×m/4-th row;

a fourth scanning driver for controlling the scanning lines extending in the (3×m/4+1)-th row to m-th row; and at least two data lines of the plurality of data lines extending in each column pixel.

35. A display device according to claim 34, wherein each of the first to fourth data drivers includes a plurality of shift registers which operate independently, a plurality of first latches, a plurality of second latches, and a plurality of sampling circuits.

36. A display device according to claim 34, wherein the first to fourth scanning drivers each includes a shift register and a buffer.

37. A display device according to claim 34, wherein the plurality of pixels, the plurality of data lines, the plurality of scanning lines, the first data driver, the second data driver, the third data driver, the fourth data driver, the first scanning driver and the second scanning driver, the third scanning driver, and the fourth scanning driver are formed over the same insulator.

38. An electroluminescent display device comprising:

a plurality of pixels which are arranged in a matrix pattern; each including a transistor and a light-emitting element;

a plurality of data lines extending from a data driver;

a plurality of scanning lines extending from a scanning driver; and a plurality of pixel columns;

wherein at least two data lines of the plurality of date lines are arranged in a first pixel column, and the at least two data lines electrically connected to different pixels which are arranged in the first pixel column; and wherein at least two data lines of the plurality of date lines are arranged in a second pixel column, and the at least two data lines electrically connected to different pixels which are arranged in the second pixel column.

39. A display device comprising:

a plurality of pixels which are arranged in a matrix pattern; each including a transistor;

a plurality of data lines extending from a data driver;

a plurality of scanning lines extending from a scanning driver; and a plurality of pixel columns;

wherein at least four data lines of the plurality of date lines are arranged in a first pixel column, and the at least four data lines electrically connected to different pixels which are arranged in the first pixel column; and wherein at least four data lines of the plurality of date lines are arranged in a second pixel column, and the at least four data lines electrically connected to different pixels which are arranged in the second pixel column.

* * * * *